US010982491B2

(12) United States Patent
Chen

(10) Patent No.: US 10,982,491 B2
(45) Date of Patent: Apr. 20, 2021

(54) FIXED-CUTTER DRILL BITS WITH TRACK-SET PRIMARY CUTTERS AND BACKUP CUTTERS

(71) Applicant: Halliburton Energy Services, Inc., Houston, TX (US)

(72) Inventor: Shilin Chen, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/624,143

(22) PCT Filed: Jul. 13, 2018

(86) PCT No.: PCT/US2018/042075
§ 371 (c)(1),
(2) Date: Dec. 18, 2019

(87) PCT Pub. No.: WO2019/022971
PCT Pub. Date: Jan. 31, 2019

(65) Prior Publication Data

US 2020/0115963 A1 Apr. 16, 2020

Related U.S. Application Data

(60) Provisional application No. 62/536,863, filed on Jul. 25, 2017.

(51) Int. Cl.
*E21B 10/43* (2006.01)

(52) U.S. Cl.
CPC ..... *E21B 10/43* (2013.01)

(58) Field of Classification Search
CPC ..... E21B 10/43; E21B 10/55
See application file for complete search history.

(56) References Cited

U.S. PATENT DOCUMENTS

| | | | | |
|---|---|---|---|---|
| 2008/0179107 | A1 | 7/2008 | Doster | |
| 2009/0266619 | A1 | 10/2009 | Durairajan et al. | |
| 2011/0100714 | A1 | 5/2011 | Moss et al. | |
| 2015/0122551 | A1* | 5/2015 | Chen | E21B 10/43 175/426 |
| 2015/0152689 | A1 | 6/2015 | Chen et al. | |
| 2016/0376846 | A1 | 12/2016 | Chen | |
| 2017/0081922 | A1 | 3/2017 | Chen et al. | |

OTHER PUBLICATIONS

International Search Report received for PCT Patent Application No. PCT/US2018/042075, dated Nov. 29, 2018; 11 pages, dated Nov. 29, 2018.

* cited by examiner

*Primary Examiner* — David J Bagnell
*Assistant Examiner* — Yanick A Akaragwe
(74) *Attorney, Agent, or Firm* — Thomas Rooney; Baker Botts L.L.P.

(57) ABSTRACT

The present disclosure relates to fixed-cutter drill bits with track-set primary cutters and backup cutters, methods of designing such bits, systems for implementing such methods, and systems for using such fixed-cutter drill bits to drill a wellbore in a geological formation.

13 Claims, 20 Drawing Sheets

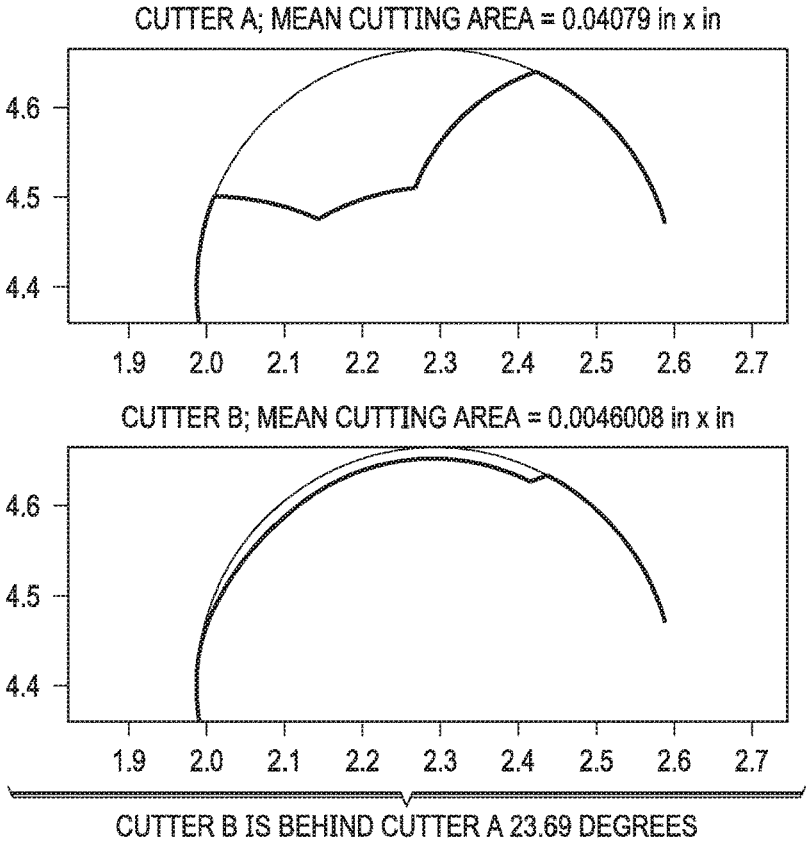
FIG. 6A
FIG. 6B
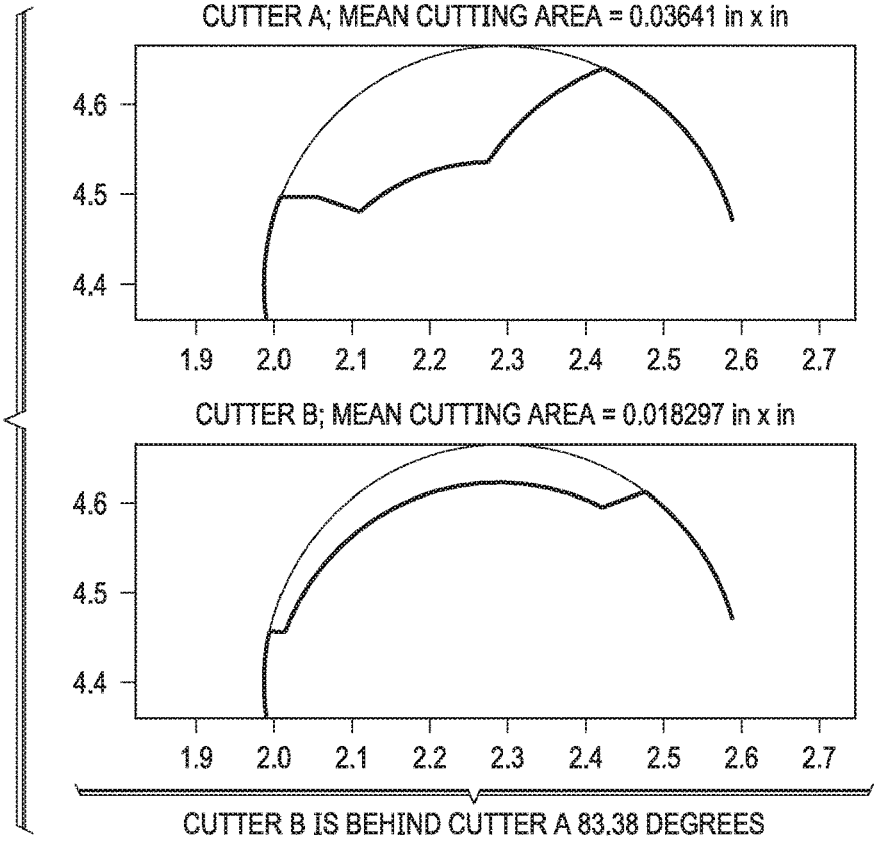

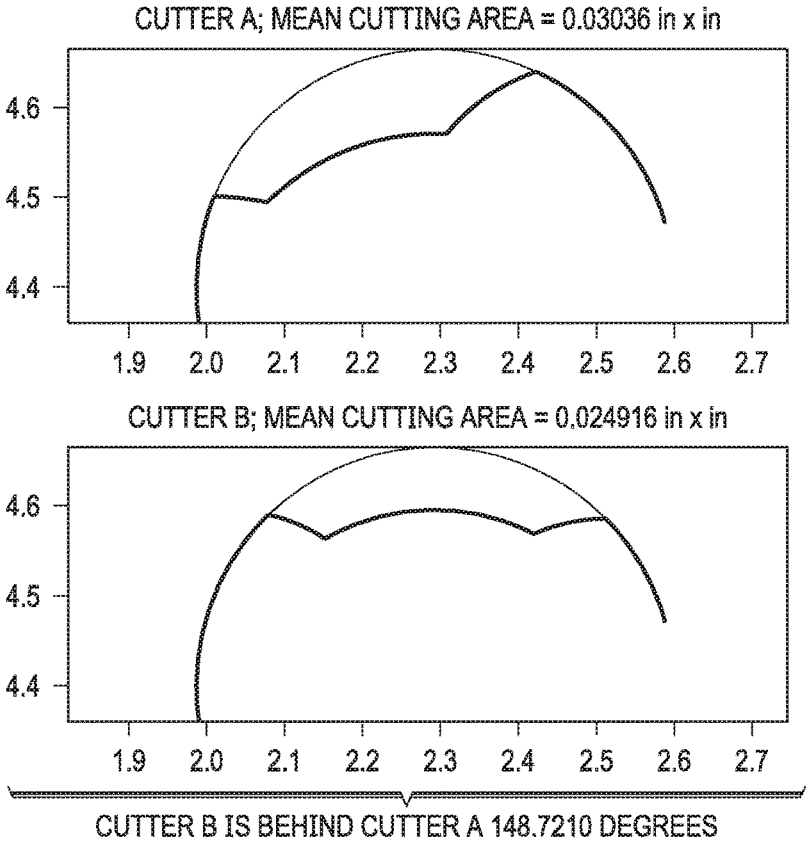
FIG. 6C
FIG. 6D
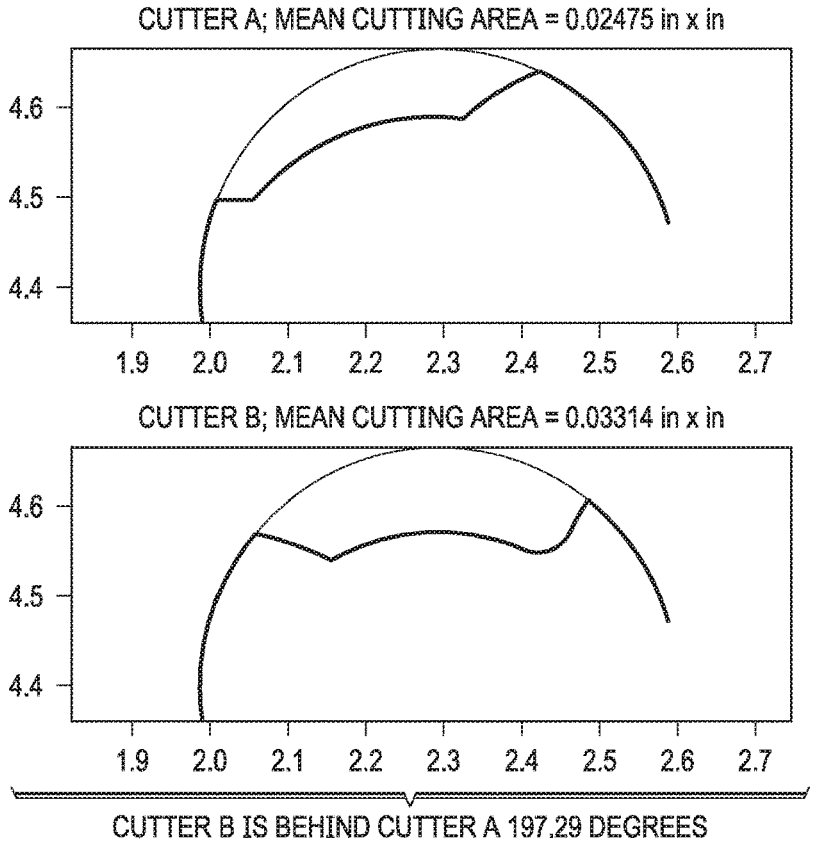

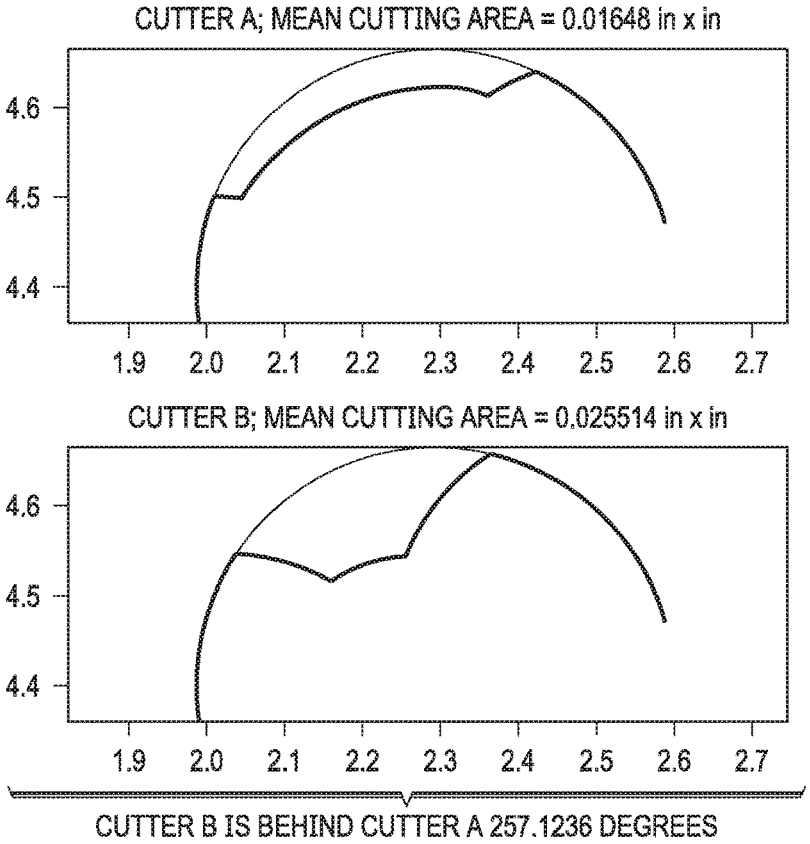
FIG. 6E
FIG. 6F
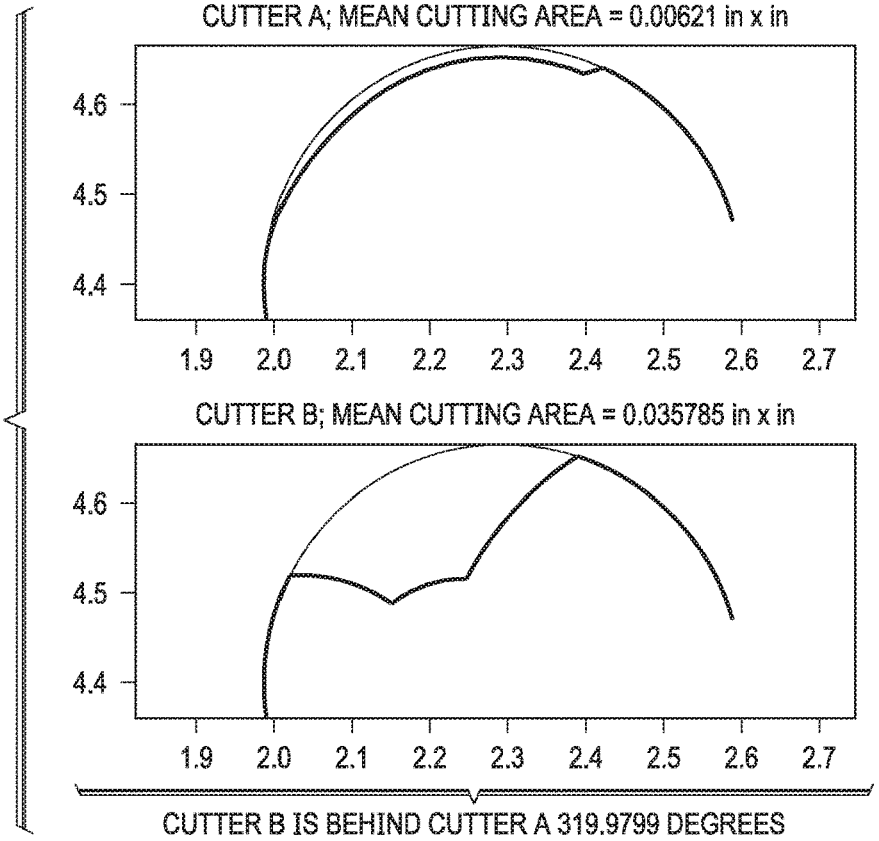

FIXED-CUTTER DRILL BITS WITH TRACK-SET PRIMARY CUTTERS AND BACKUP CUTTERS

PRIORITY CLAIM

The present application is a U.S. National Stage Application of International Application No. PCT/US2018/042075 filed Jul. 13, 2018, which designates the United States and claims priority to U.S. Provisional Patent Application Ser. No. 62/536,863 titled "FIXED-CUTTER DRILL BITS WITH TRACK-SET PRIMARY CUTTERS AND BACKUP CUTTERS", filed Jul. 25, 2017, which is incorporated by reference herein in its entirety.

TECHNICAL FIELD

The present disclosure relates generally to fixed-cutter drill bits with track-set primary cutters and backup cutters, methods of designing such bits, systems for implementing such methods, and systems for using such fixed-cutter drill bits to drill a wellbore in a geological formation.

BACKGROUND

Wellbores are most frequently formed in geological formations using earth-boring drill bits. Various types of such bits exist, but all of them experience some type of wear or fatigue from use that limits the overall life of the bit or the time it may spend downhole in the wellbore before being returned to the surface. The materials used in the bit and their ability to effectively cut different types of formations encountered as the wellbore progresses also sometimes necessitate removing the bit from the wellbore, replacing bit or components of it, and returning it downhole to resume cutting.

Particularly as wellbores reach greater lengths, the process of removing and returning a bit becomes time consuming and costly. In addition, the bit and bit components themselves are costly and are time consuming to make or replace. As a result, those involved in designing, manufacturing, and operating earth-boring drill bits and their components spend a substantial amount of time developing ways to limit removal and return of a bit in a wellbore as well as ways to improve the life of the bit and its components. These efforts are complicated, however, by the fact that earth-boring drill bits and their components and operation are often quite complex, resulting in some improvements being found to be impractical to implement.

BRIEF DESCRIPTION OF THE DRAWINGS

A more complete understanding of the present disclosure and its features and advantages thereof may be acquired by referring to the following description, taken in conjunction with the accompanying drawings, which are not necessarily to scale, in which like reference numbers indicate like features, and wherein:

FIG. 5 (right) is a track diagram of the cutters of the fixed-cutter drill bit;

FIG. 6 is a set of schematic diagrams of the engagement areas of a primary cutter and a track-set backup-cutter, depending on angle θ;

FIG. 7 (right) is a schematic diagram of a primary cutter and the relative under-exposure of a track-set backup cutter when there is wear (w) to the primary cutter;

DETAILED DESCRIPTION

The present disclosure relates to fixed-cutter drill bits with primary cutters and track-set backup cutters. In particular, the disclosure relates to methods of designing such bits to determine an appropriate location for the track-set backup cutters. The disclosure also relates to systems for implementing the bit design method, fixed-cutter drill bits designed using such a method, and systems for forming a wellbore in geological formations using such bits.

The methods of this disclosure may be used to design bits in which bit life is extended without sacrificing rate of penetration. The methods may also be used to design bits that may be used for drilling both soft and hard formations, without the need to remove the bit from the wellbore, replace it with a different bit or to replace the cutters with different cutters, then return the bit to the wellbore.

The present disclosure may be further understood by referring to FIGS. 1-22, where like numbers are used to indicate like and corresponding parts.

Figure 1:
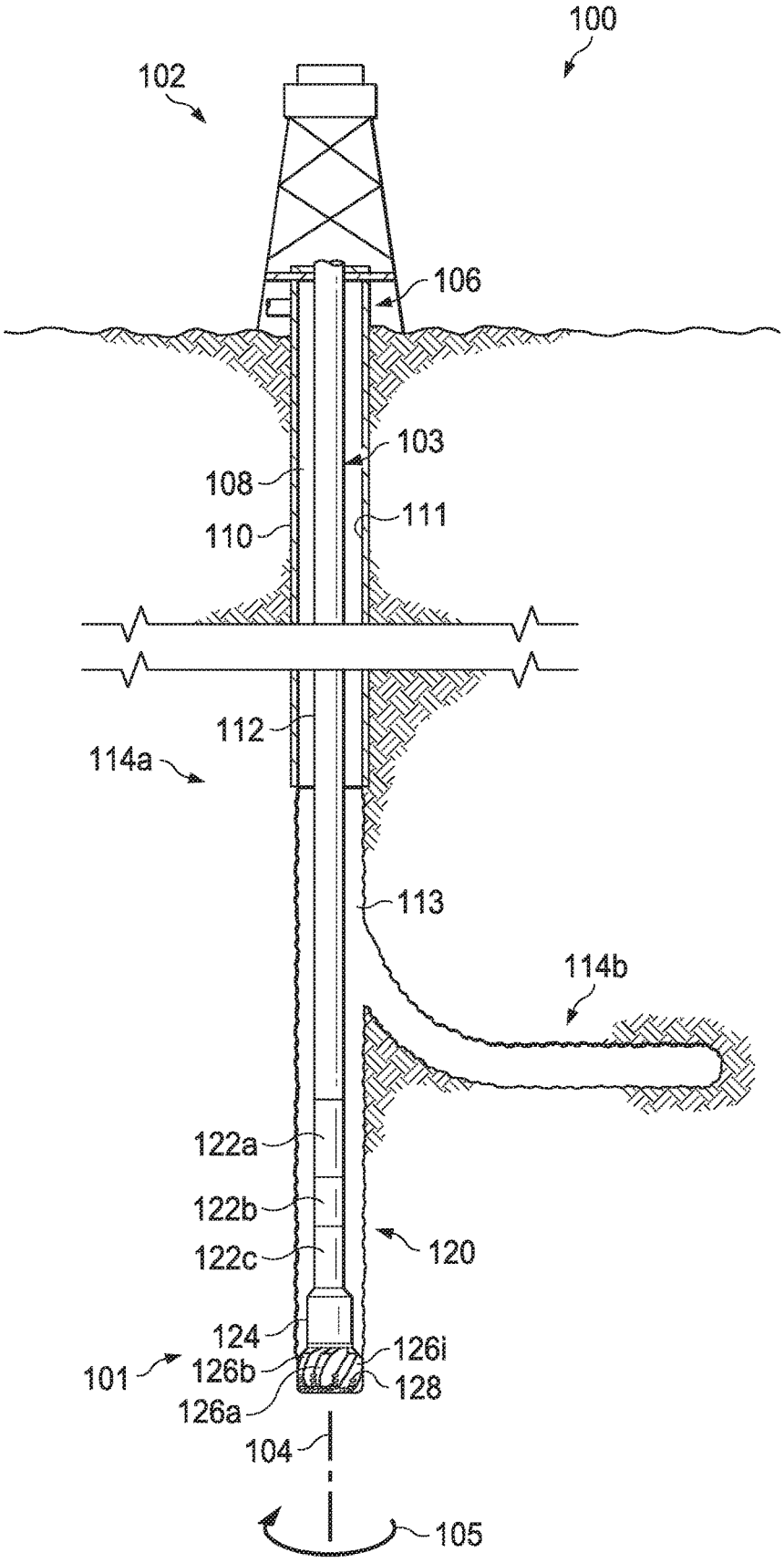
FIG. 1 is a schematic diagram of a drilling system in which a fixed-cutter drill bit with track-set primary cutters and backup cutters according to the present disclosure may be used.

FIG. 1 is a schematic diagram of a drilling system 100 configured to drill into one or more geological formations to form a wellbore. Drilling system 100 may include a fixed-cutter drill bit 101 according to the present disclosure.

Drilling system 100 may include well surface or well site 106. Various types of drilling equipment such as a rotary table, mud pumps and mud tanks (not expressly shown) may be located at a well surface or well site 106. For example, well site 106 may include drilling rig 102 that may have various characteristics and features associated with a "land drilling rig." However, fixed-cutter drill bits according to the present disclosure may be satisfactorily used with drilling equipment located on offshore platforms, drill ships, semi-submersibles and drilling barges (not expressly shown).

Drilling system 100 may include drill string 103 associated with fixed-cutter drill bit 101 that may be used to form a wide variety of wellbores or bore holes such as generally vertical wellbore 114*a* or generally horizontal wellbore 114*b* as shown in FIG. 1. Various directional drilling techniques and associated components of bottom hole assembly (BHA) 120 of drill string 103 may be used to form generally horizontal wellbore 114*b*. For example, lateral forces may be applied to drill bit 101 proximate kickoff location 113 to form generally horizontal wellbore 114*b* extending from generally vertical wellbore 114*a*. Wellbore 114 is drilled to a drilling distance, which is the distance between the well surface and the furthest extent of wellbore 114, and which increases as drilling progresses.

BHA 120 may be formed from a wide variety of components configured to form a wellbore 114. For example, components 122*a*, 122*b* and 122*c* of BHA 120 may include, but are not limited to, drill bit, such as fixed-cutter drill bit 101, drill collars, rotary steering tools, directional drilling tools, downhole drilling motors, reamers, hole enlargers or stabilizers. The number of components such as drill collars and different types of components 122 included in BHA 120 may depend upon anticipated downhole drilling conditions and the type of wellbore that will be formed by drill string 103 and fixed-cutter drill bit 101.

Wellbore 114 may be defined in part by casing string 110 that may extend from well site 106 to a selected downhole location. Portions of wellbore 114 as shown in FIG. 1 that do not include casing string 110 may be described as "open hole." Various types of drilling fluid may be pumped from well site 106 through drill string 103 to attached drill bit 101. Such drilling fluids may be directed to flow from drill string 103 to respective nozzles (item 156 illustrated in FIG. 2A) included in fixed-cutter drill bit 101. The drilling fluid may be circulated back to well surface 106 through annulus 108 defined in part by outside diameter 112 of drill string 103 and inside diameter 118*a* of wellbore 114. Inside diameter 118*a* may be referred to as the "sidewall" of wellbore 114. Annulus 108 may also be defined by outside diameter 112 of drill string 103 and inside diameter 111 of casing string 110.

Figure 2:
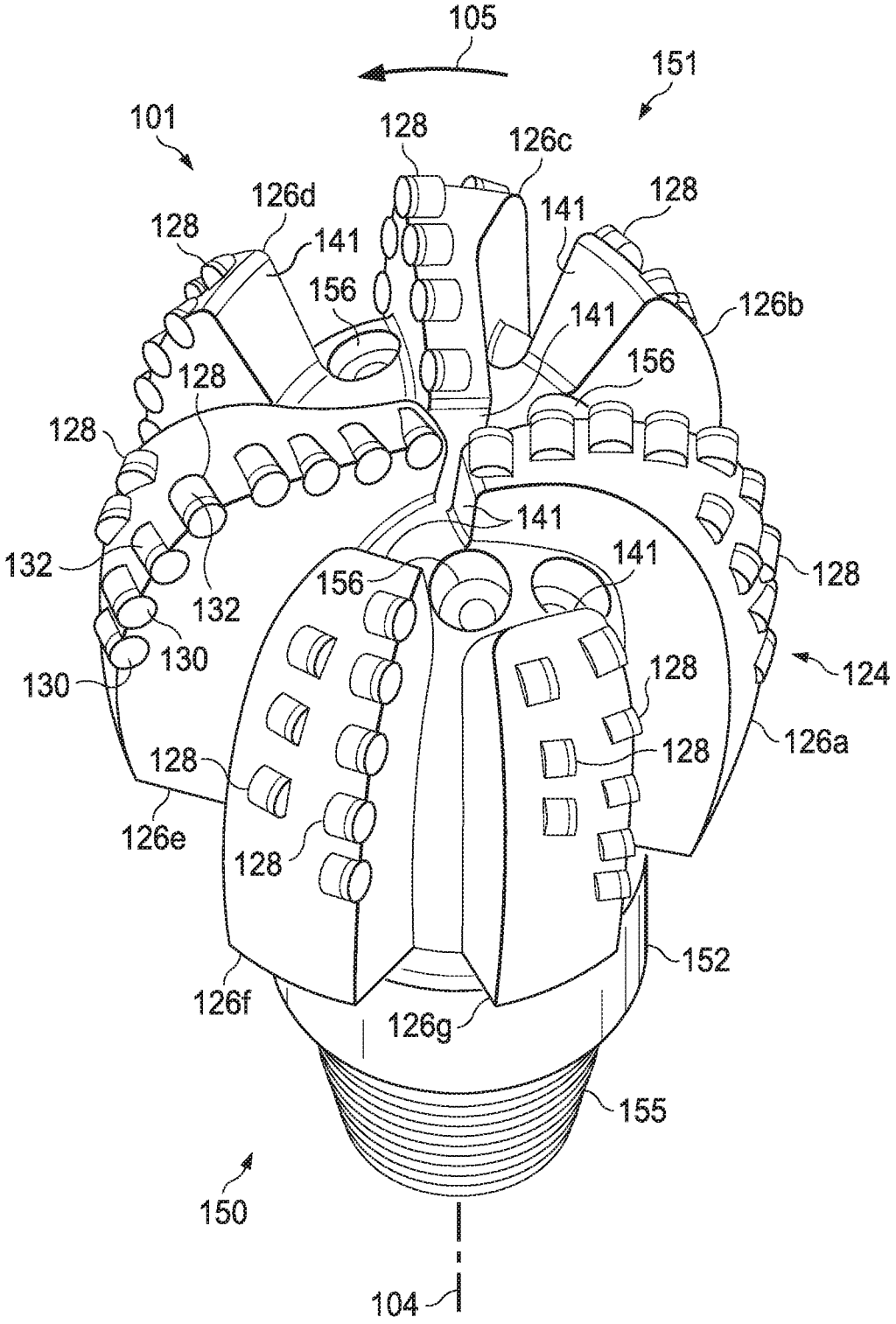
FIG. 2 is an isometric view of a fixed-cutter drill bit with track-set primary cutters and backup cutters.

FIG. 2 is an isometric view of fixed-cutter drill bit 101 oriented upwardly in a manner often used to model or design fixed-cutter drill bits. Fixed-cutter drill bit 101 may be designed and formed in accordance with teachings of the present disclosure and may have many different designs, configurations, and/or dimensions according to the particular application of drill bit 101.

Uphole end 150 of fixed-cutter drill bit 101 may include shank 152 with drill pipe threads 155 formed thereon. Threads 155 may be used to releasably engage fixed-cutter drill bit 101 with BHA 120 (as shown in FIG. 1), whereby fixed-cutter drill bit 101 may be rotated relative to bit rotational axis 104. Downhole end 151 of fixed-cutter drill bit 101 may include a plurality of blades 126*a*-126*g* with respective junk slots or fluid flow paths disposed therebetween. Additionally, drilling fluids may be communicated to one or more nozzles 156.

The plurality of blades 126 (e.g., blades 126*a*-126*g*) may be disposed outwardly from exterior portions of rotary bit body 124 of fixed-cutter drill bit 101. Bit body 124 may be generally cylindrical and blades 126 may be any suitable type of projections extending outwardly from bit body 124. For example, a portion of blade 126 may be directly or indirectly coupled to an exterior portion of bit body 124, while another portion of blade 126 is projected away from the exterior portion of bit body 124. Blades 126 may have a wide variety of configurations including, but not limited to, substantially arched, helical, spiraling, tapered, converging, diverging, symmetrical, and/or asymmetrical.

In some cases, one or more blades 126 may have a substantially arched configuration extending from proximate bit rotational axis 104 of fixed-cutter drill bit 101. The arched configuration may be defined in part by a generally concave, recessed shaped portion extending from proximate bit rotational axis 104. The arched configuration may also be defined in part by a generally convex, outwardly curved portion disposed between the concave, recessed portion and exterior portions of each blade which correspond generally with the outside diameter of the rotary drill bit.

Blades 126*a*-126*g* may include primary blades disposed about the bit rotational axis. For example, in FIG. 2, blades 126*a*, 126*c*, and 126*e* may be primary blades or major blades because respective first ends 141 of each of blades 126*a*, 126*c*, and 126*e* may be disposed closely adjacent to associated bit rotational axis 104. Blades 126*a*-126*g* may also include at least one secondary blade disposed between the primary blades. Blades 126*b*, 126*d*, 126*f*, and 126*g* shown in FIG. 2 on fixed-cutter drill bit 101 may be secondary blades or minor blades because respective first ends 141 may be disposed on downhole end 151 a distance from associated bit rotational axis 104. The number and location of secondary blades and primary blades may vary such that fixed-cutter drill bit 101 includes fewer or greater secondary and primary blades than are shown in FIG. 2. Blades 126 may be disposed symmetrically or asymmetrically with regard to each other and bit rotational axis 104 where the disposition may be based on the downhole drilling conditions of the drilling environment.

In some cases, blades 126 and fixed-cutter drill bit 101 may rotate about rotational axis 104 in a direction defined by directional arrow 105. Each blade 126 may have a leading (or front) surface disposed on one side of the blade in the direction of rotation of fixed-cutter drill bit 101 and a trailing (or back) surface disposed on an opposite side of the blade away from the direction of rotation of fixed-cutter drill bit 101. Blades 126 may be positioned along bit body 124 such that they have a spiral configuration relative to rotational axis 104. Alternatively, blades 126 may be positioned along bit body 124 in a generally parallel configuration with respect to each other and bit rotational axis 104.

Blades 126 include one or more cutters 128 disposed outwardly from exterior portions of each blade 126. For example, a portion of a cutter 128 may be directly or indirectly coupled to an exterior portion of blade 126 while another portion of the cutter 128 may be projected away from the exterior portion of blade 126. Cutters 128 may be any suitable device configured to cut into a formation, such as various types of compacts, buttons, inserts, and gage cutters satisfactory for use with a wide variety of fixed-cutter drill bits 101.

One or more of cutters 128 may include a substrate with a layer of hard cutting material disposed on one end of the substrate. The layer of hard cutting material may be a compact, such as a polycrystalline diamond compact. The layer of hard cutting material may provide a cutting surface 130 of cutter 128 that may engage adjacent portions of a formation to form wellbore 114. The contact of the cutting surface 130 with the formation may form a cutting zone associated with each of cutter 128. The edge of the cutting surface 130 located within the cutting zone may be referred to as the cutting edge of a cutter 128. Cutter 128 may also include a side surface 132.

Often a wellbore, such as wellbore 114, will be drilled through formations with different properties, such as different hardnesses. Rather than use two different bits to drill the two formations, instead a fixed-cutter drill bit 101 with both primary cutters and backup cutters may be used. Such a fixed-cutter drill bit 101 typically includes a first set of cutters 128A, called primary cutters, which may function as major cutters when fixed-cutter drill bit 101 is first used to drill a wellbore in a formation. The fixed-cutter drill bit 101 also includes as second set of cutters 128B, called backup cutters, which may function as minor cutters when fixed-cutter drill bit 101 is first used to drill a wellbore in a formation. Although the present specification discusses multiple primary cutters 128A and backup cutters 128B because many fixed-cutter drill bits 101 will include a plurality of both types of cutters 128, a fixed-cutter drill bit 101 including a single primary cutter 128A and backup cutter 128B and methods and systems for designing and using such a bit are also included in the present disclosure.

When designing a fixed-cutter drill bit 101 including primary cutters 128A and backup cutters 128B, there are at least two challenges presented, a goal is often to avoid backup cutters 128B cutting the formation before sufficient wear of the primary cutters 128A. Another goal is to ensure that backup cutters 128B do cut the formation or function as the major cutters after sufficient wear of the primary cutters 128A.

During drilling, fixed-cutter drill bit 101 rotates in direction 105 around bit rotational axis 104 to remove the formation and create wellbore 114. The rate at which the formation is removed as fixed-cutter drill bit rotates is referred to as the rate of penetration (ROP) and is typically measured in length unit/time unit, such as feet/hour. The rate at which fixed-cutter drill bit 101 rotates in direction 105 around bit rotational axis 104 is referred to as the rotational speed of the bit, typically expressed as rotations/unit time, such as rotations/minute (RPM). The axial penetration of a fixed-cutter drill bit 101 per revolution around bit rotational axis 104 is referred to as the depth of cut (DOC) of the bit. Depth of cut is typically measured in length unit/revolution, such as inches/revolution.

For a given rate of penetration in feet/hour and rotations per minute, the depth of cut in inches/revolution of fixed-cutter drill bit 101 is given by the equation:

$$DOC=ROP/(5\times RPM) \quad (1a).$$

Figure 3:
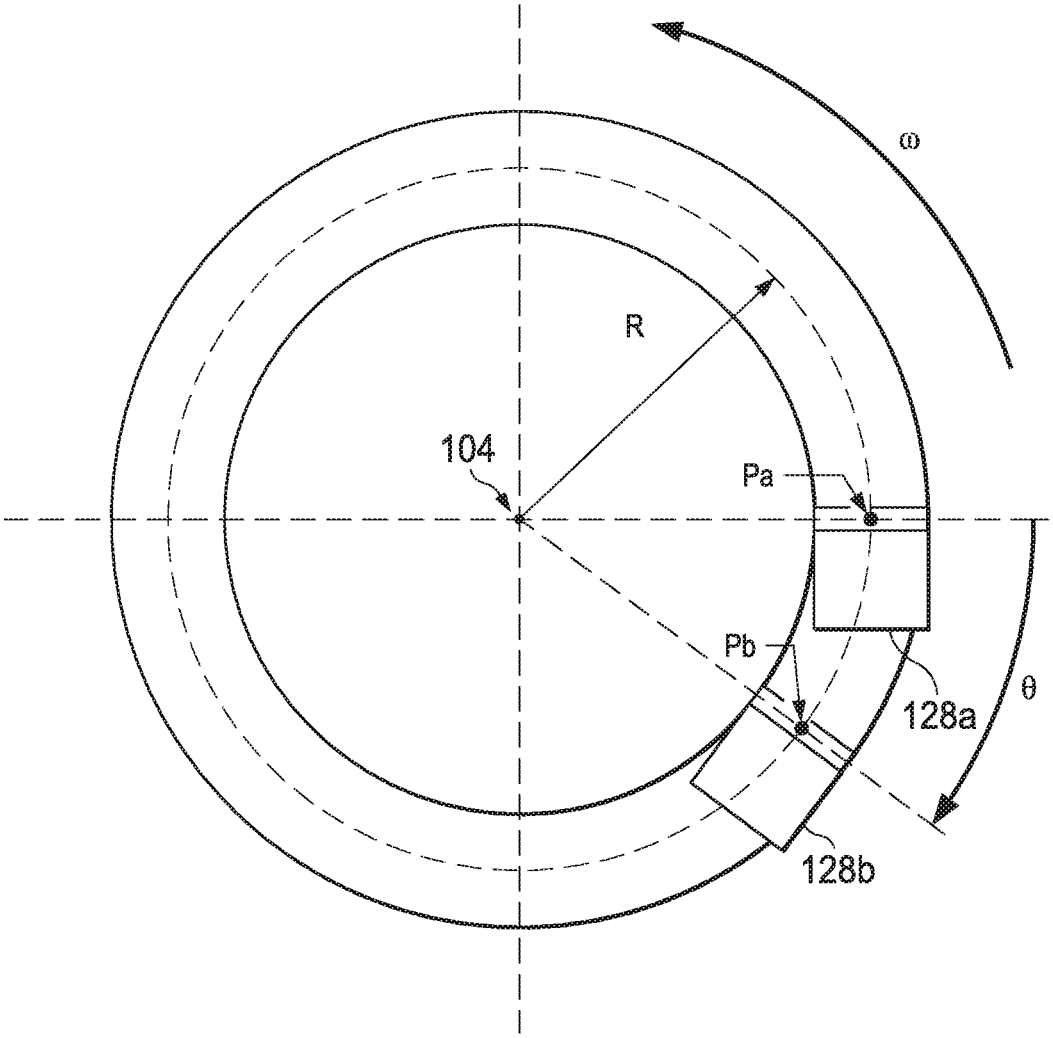
FIG. 3 is a schematic view showing the relative positions of a primary cutter, and a track-set backup cutter.

DOC in equation (1a) is defined in bit level. However, DOC may be shared by cutters 128 on fixed-cutter drill bit 101 such that each cutter may have its own DOC. A cutter's DOC depends on the amount of overlap with neighboring cutters on a bit profile of fixed-cutter drill bit 101. FIG. 3 illustrates this principle for a two-cutter fixed-cutter drill bit 101. Primary cutter 128A and backup cutter 128B are track-set, meaning that they are located at the same radial locations on fixed-cutter drill bit 101 and have the same height. The same radial location is illustrated using points Pa and Pb, which correspond to the cylindrical axes of primary cutter 128A and backup cutter 128B, respectively. Both points Pa and Pb are the same radius R from bit rotational axis 104.

During one revolution of fixed-cutter drill bit 101, point Pa on primary cutter 128A and point Pb on backup cutter 128B share the depth of cut (DOC) of the bit. A cutter with a 50% or greater share of the depth of cut (DOC) of the bit during the revolution is referred to as a major cutter. A cutter with a less than 50% share of the depth of cut (DOC) of the bit during the revolution is referred to as a minor cutter. Depth of cut (DOC) may be inferred from the engagement area of a particular cutter, as the two characteristics vary directly. The engagement area is the area of the cutter that contacts the formation during drilling. For a worn cutter, the engagement area is a function of the back rake angle of the cutter in the drill bit as well as of the wear (w).

The depth of cut (DOC) of point Pb in inches per revolution may be calculated as a function of angle θ, which is the angle between point Pa and point Pb as measured with respect to bit rotational axis 104:

$$DOC_b=DOC\theta/360 \quad (1b).$$

The depth of cut of point Pa may be calculated in inches/revolution as:

$$DOC_a=DOC-DOC_b \quad (1c.)$$

Figure 4:
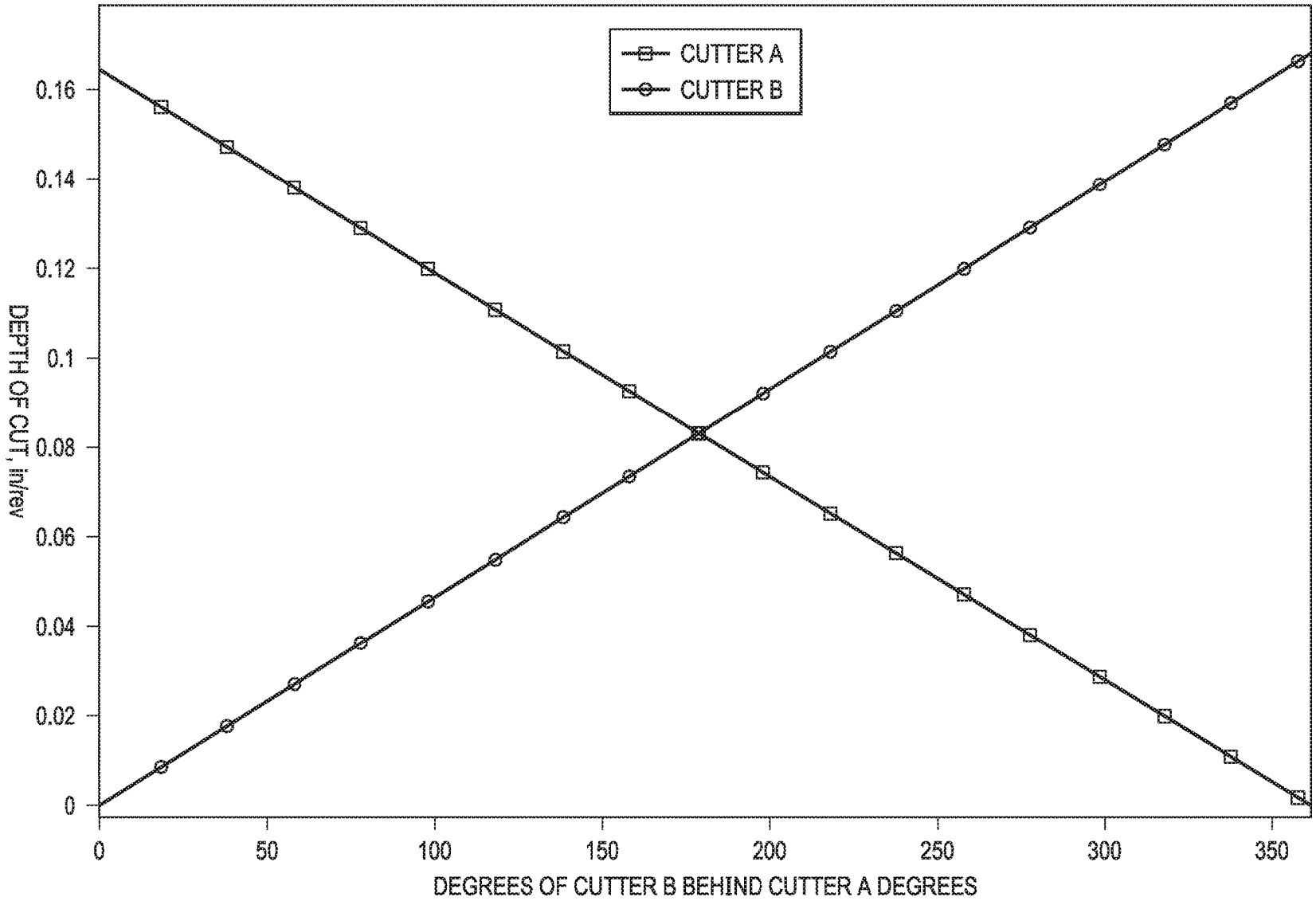
FIG. 4 is a graph of the depth-of-cut of a primary cutter and a backup cutter a of FIG. 3 as a function of angle (θ)

In an example method of designing a fixed-cutter drill bit 101 for drilling a wellbore, in which the bit has a rate of penetration (ROP) of 100 feet/hour and a rotations per minute (RPM) of 120, then the depth of cut (DOC) for the bit is 0.16666 inches/revolution. FIG. 4 shows the depth of cut of point Pa ($DOC_a$) and the depth of cut of point Pb (DOC $P_b$) as a function of angle θ.

As illustrated in FIG. 4, when backup cutter 128B is behind primary cutter 128A at an angle θ of 180.0 degrees, then primary cutter 128A and backup cutter 128B share the depth of cut (DOC) of fixed-cutter drill bit 101 equally because primary cutter 128A and backup cutter 128B have the same engagement area. Both primary cutter 128A and backup cutter 128B may be considered as major cutters.

When backup cutter 128B is rotationally behind primary cutter 128A at an angle θ that is less than 180.0 degrees, primary cutter 128A shares more depth of cut (DOC) than backup cutter 128B because primary cutter 128A engages the formation deeper than backup cutter 128B. Primary cutter 128A is a major cutter and backup cutter 128B is a minor cutter in this situation.

When backup cutter 128B is rotationally behind primary cutter 128A at an angle θ that is greater than 180.0 degrees, backup cutter 128B shares more depth of cut (DOC) than primary cutter 128A because backup cutter 128B engages the formation deeper than primary cutter 128A. In this situation, backup cutter 128B is a major cutter and primary cutter 128A is a minor cutter.

Applying the principle of this example more generally, for a track set pair of cutters, which cutter is a major cutter and which cutter is a minor cutter depends on their angular location, as measured with respect to the bit rotational axis of the fixed-cutter drill bit on which the cutters are located.

Figure 5:
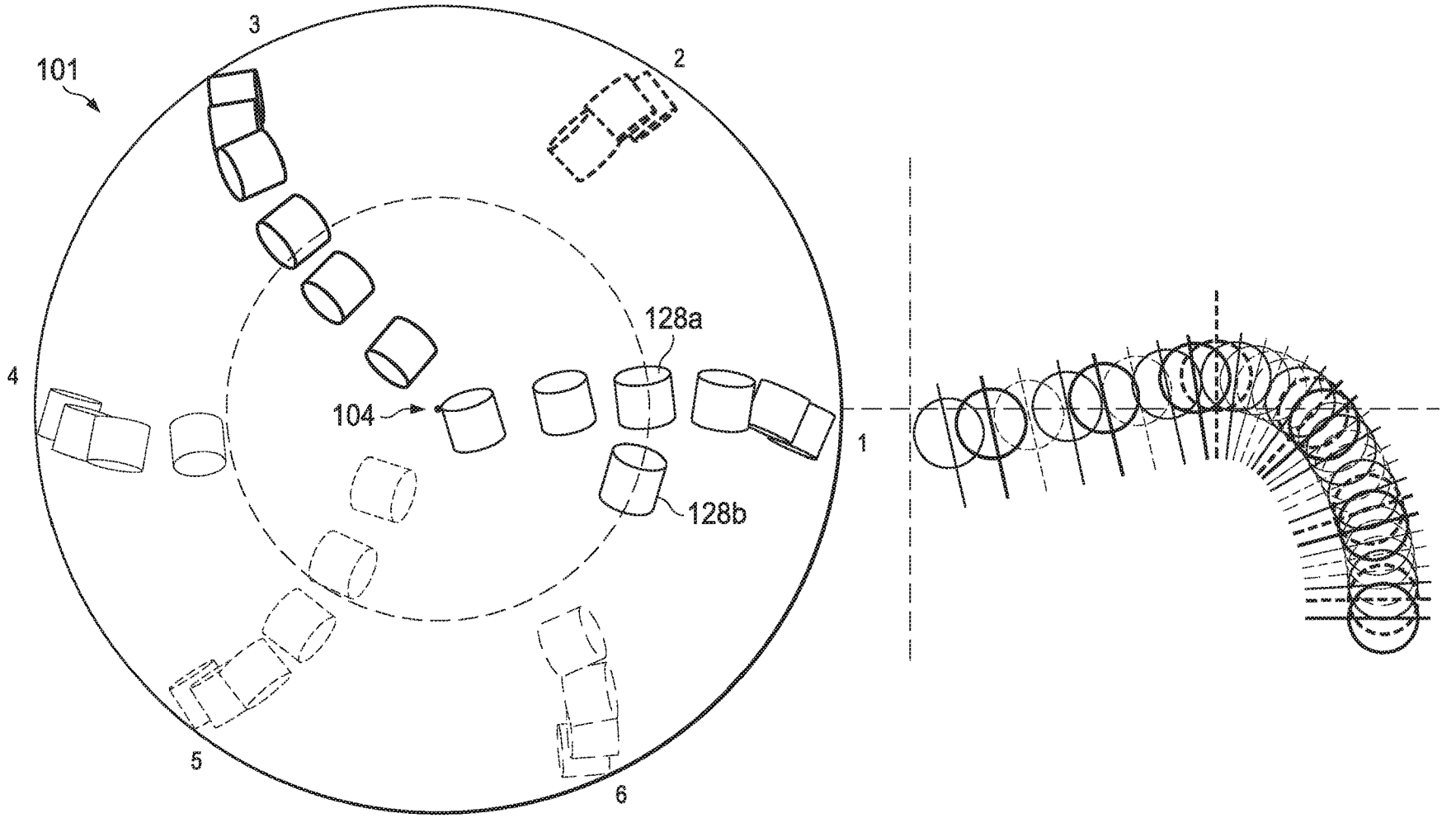
FIG. 5 (left) is a schematic diagram of the relative locations of a primary cutter and a track-set backup cutter on a fixed-cutter drill bit.

In another example of a method of designing a fixed-cutter drill bit 101 for drilling a wellbore as illustrated in FIG. 5, the fixed-cutter drill bit 101 may have six blades. For clarity, only the cutters on these blades are illustrated in FIG. 5 (left). The blades are numbered 1 to 6. FIG. 5 (right) also provides a track diagram of cutters 128.

Cutters 128 on fixed-cutter drill bit 101 include two track-set cutters, primary cutter 128A and backup cutter 128B. FIG. 5 illustrates primary cutter 128A and backup cutter 128B on the same blade, blade 1, but backup cutter 128B may also be located on any other of blades 2-6. In general, the principles disclosed herein may be applied to any track-set cutters on a fixed-cutter drill bit having any number of blades, with the primary and backup cutters located on any of the blades.

Using the fixed-cutter drill bit 101 of FIG. 5, or variations with backup cutter 128B on blades 2-6, if track-set primary cutter 128A and backup cutter 128B are the same size and are set in fixed-cutter drill bit 101 at the same back rake angles and the fixed-cutter drill bit 101 has a rate of penetration (ROP) of 100 feet/hour and a rotations per minute (RPM) of 120, calculated engagement areas for primary cutter 128A and backup cutter 128B, with varying angles θ, are as depicted in FIG. 6.

Specifically, in FIG. 6A, backup cutter 128B is rotationally behind primary cutter 128A at an angle θ of 23.69 degrees (backup cutter 128B is on blade 1). The engagement area of primary cutter 128A is 8.8 times larger than that of backup cutter 128B, such that primary cutter 128A is a major cutter and backup cutter 128B is a minor cutter. The cutting efficiency of backup cutter 128B is very low because the depth of cut of cutter B ($DOC_b$) is too low to form any rock chips in front of backup cutter 128B.

In FIG. 6B, backup cutter 128B is rotationally behind primary cutter 128A at an angle θ of 83.38 degrees (backup cutter 128B is on blade 6). The engagement area of primary cutter 128A still larger than that of backup cutter 128B, such that primary cutter 128A is still a major cutter and backup cutter 128B is a minor cutter, although the engagement area of backup cutter 128B is increases as compared to when backup cutter 128B is on blade 1. The cutting efficiency of backup cutter 128B is still low but also higher than when backup cutter 128B is on blade 1.

In FIG. 6C, backup cutter 128B is rotationally behind primary cutter 128A at an angle θ of 148.72 degrees (backup cutter 128B is on blade 5). The engagement area of primary cutter 128A is 0.03036 $in^2$ and the engagement area of backup cutter 128B is 0.024916 $in^2$. Although both cutters have nearly the same engagement area, primary cutter 128A is still the major cutter, while backup cutter 128B is still the minor cutter.

In FIG. 6D, backup cutter 128B is rotationally behind primary cutter 128A at an angle θ of 197.29 degrees (backup cutter 128B is on blade 4). The engagement area of primary cutter 128A is 0.02475 $in^2$ and the engagement area of backup cutter 128B is 0.03314 $in^2$. Although both cutters again have nearly the same engagement area, backup cutter 128B is a major cutter in this configuration, while primary cutter 128A is a minor cutter.

In FIG. 6E, backup cutter 128B is rotationally behind primary cutter 128A at an angle θ of 257.12 degrees (backup cutter 128B is on blade 3). The engagement area of primary cutter 128A is 0.01648 $in^2$ and the engagement area of backup cutter 128B is 0.025514 $in^2$. Backup cutter 128B has a larger engagement area than primary cutter 128A, such that backup cutter 128B is a major cutter and primary cutter 128A is a minor cutter.

In FIG. 6F, backup cutter 128B is rotationally behind primary cutter 128A at an angle θ of 319.97 degrees (backup cutter 128B is on blade 3). The engagement area of primary cutter 128A is 0.00621 $in^2$ and the engagement area of backup cutter 128B is 0.035785 $in^2$. Backup cutter 128B has a substantially larger engagement area than primary cutter 128A, such that backup cutter 128B is a major cutter and primary cutter 128A is a minor cutter.

The above example illustrates how, even when two cutters are track-set, the angle θ between the cutters plays a significant role in their relative engagement areas with the formation. The principles of this example may be applied in the design of a fixed-cutter drill bit.

In particular, in order for backup cutter 128B to have a smaller engagement area than primary cutter 128A, backup cutter 128 B may be located rotationally behind cutter A an angle θ of less than 180 degrees. In a fixed-cutter drill bit 101, because backup cutter 128B is located on a blade, this angle θ typically varies between 10-150 degrees. Cutting efficiency of backup cutter 128B is lower than that of primary cutter 128A, so that it is not appropriate to use backup cutter 128B as a backup cutter.

In order for backup cutter 128B and primary cutter 128A to have a similar engagement area, backup cutter 128B may be located rotationally behind primary cutter 128A an angle θ of 180 degrees, or close to 180 degrees. In a fixed-cutter drill bit 101, because backup cutter 128B is located on a blade, this angle θ typically varies between 150-210 degrees. Cutting efficiency of backup cutter 128B and primary cutter 128A is similar, such that it is appropriate to use backup cutter 128B as a backup cutter.

In order for backup cutter 128B to have a larger engagement area than primary cutter 128A, backup cutter 128B may be located rotationally behind primary cutter 128A an angle θ of greater than 180 degrees, usually, typically 210-330 degrees. In a fixed-cutter drill bit 101, because backup cutter 128B is located on a blade, this angle typically varies between 210-250 degrees. Cutting efficiency of backup cutter 128B is higher than that of primary cutter 128A, such that it is appropriate to use backup cutter 128B as a backup cutter if primary cutter 128A experiences heavy wear.

In order for backup cutter 128B to become a major cutter, it should be located rotationally behind primary cutter 128A at an angle θ of 180 degrees or greater.

Figure 7:
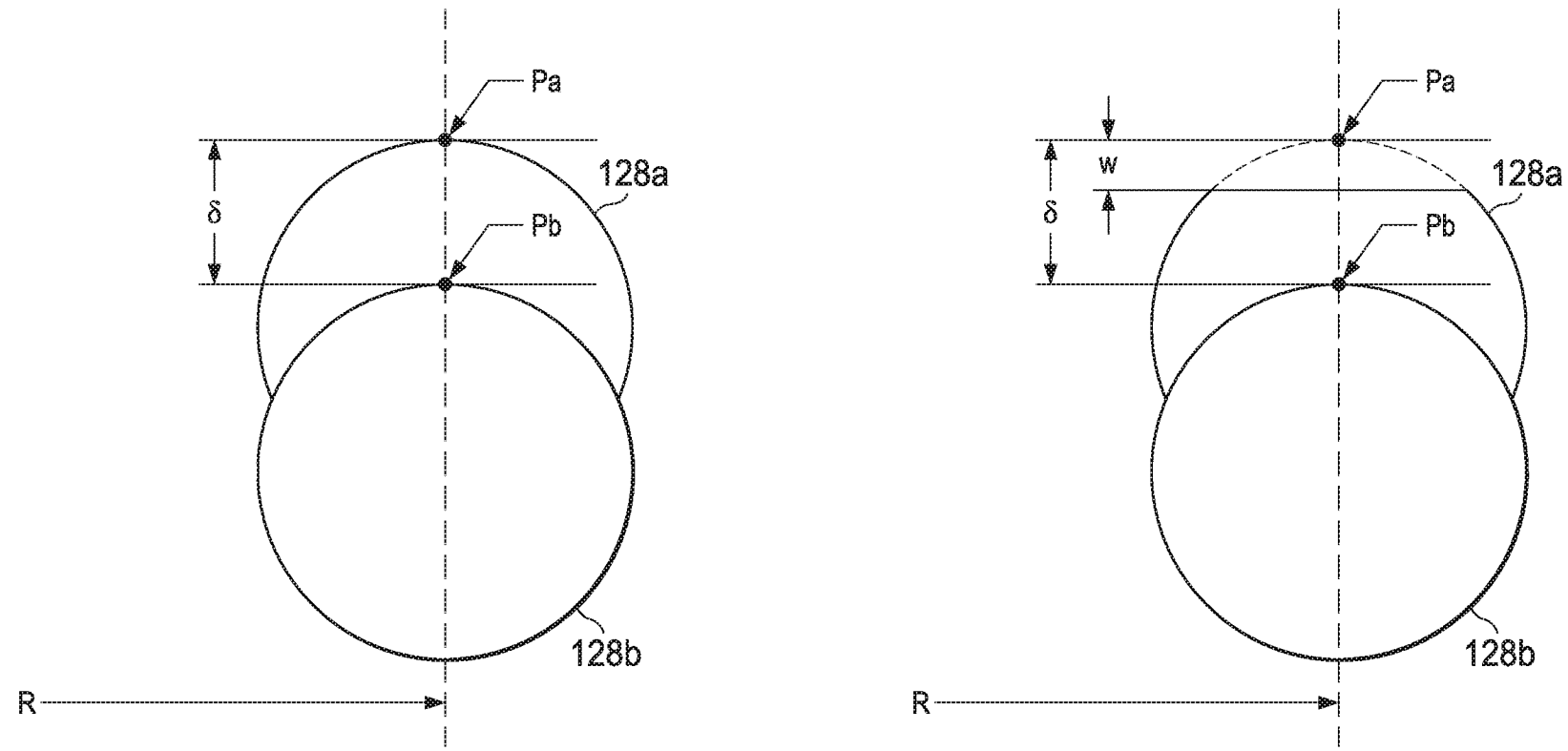
FIG. 7 (left) is a schematic diagram of primary cutter a and the under-exposure (δ) of a track-set backup cutter when there is no wear to the primary cutter.
Figure 8:
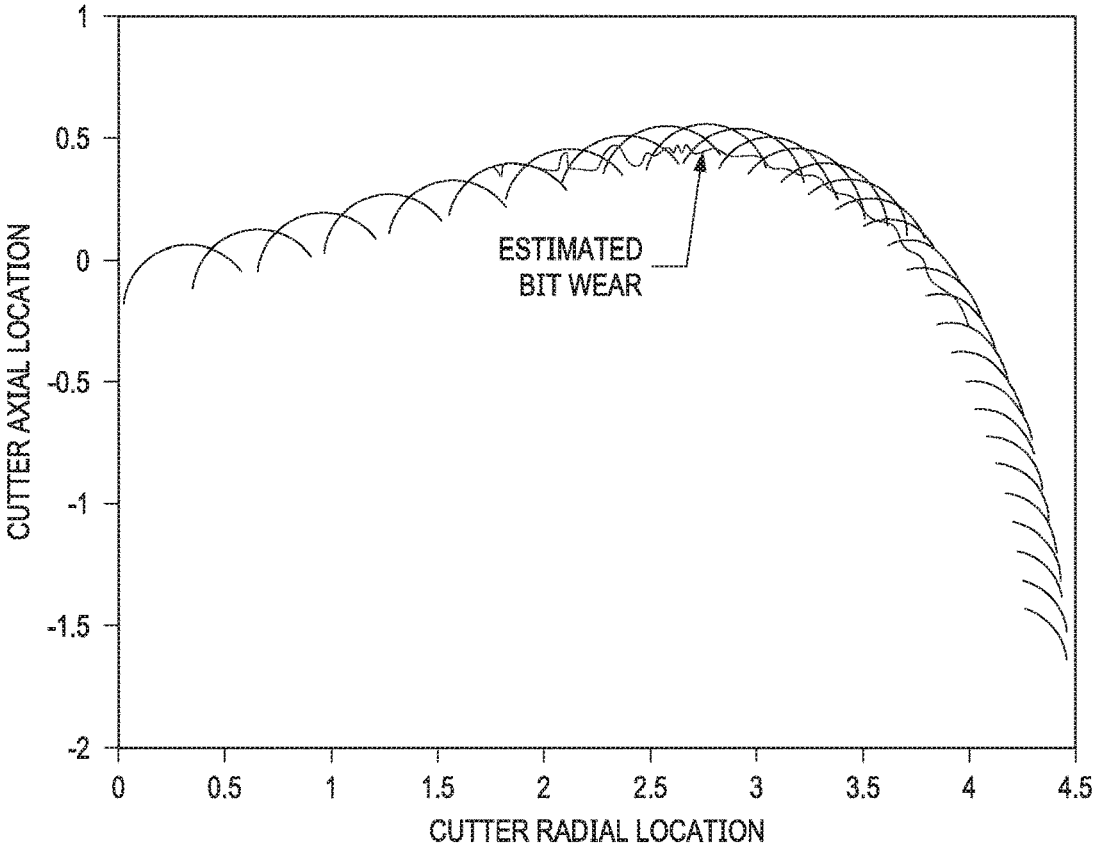
FIG. 8 is a graph of calculated bit wear for a fixed-cutter drill bit.
Figure 9:
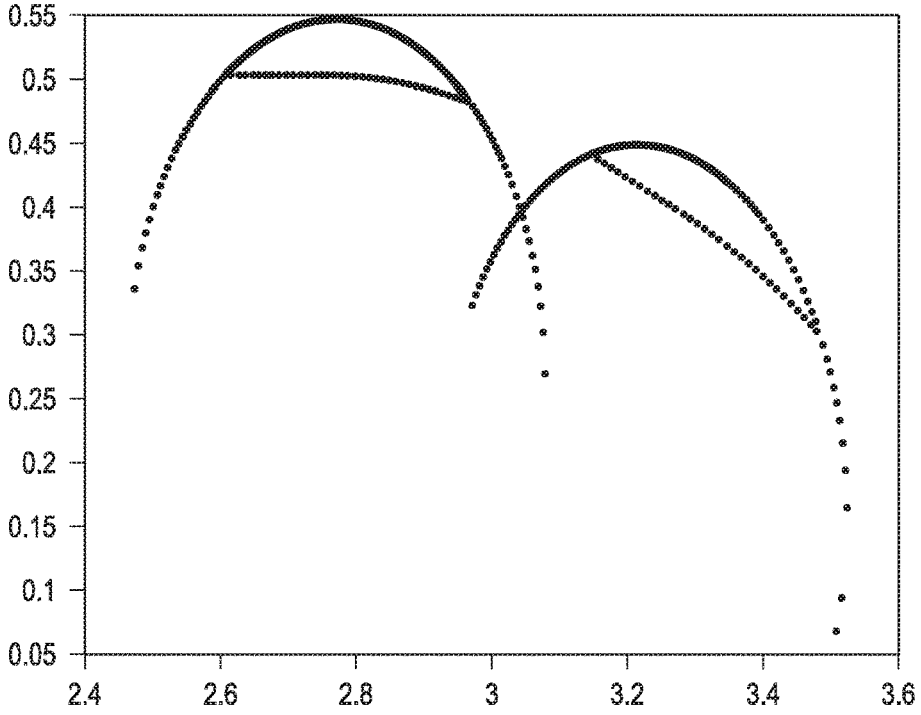
FIG. 9 is a graph of changes to cutting edges during cutter wear on a fixed-cutter drill bit with dashed lines representing worn cutting edges.

The above examples of the effects of angle θ on engagement area of primary cutter 128A and backup cutter 128B assume the same height for both cutters on fixed cutter drill bit 101. However, backup cutter 128B positioned otherwise as illustrated in FIG. 3, may be positioned axially below primary cutter 128A, as illustrated in FIG. 7 (left panel), with a distance δ between points Pa and Pb. The distance 6 is referred to as under-exposure of backup cutter 128B relative to primary cutter 128A.

Due to under-exposure, for a given depth of cut (DOC) of fixed-cutter drill bit 101, backup cutter 128B may or may not engage the formation depending on the under-exposure, δ and the angle, θ. A critical depth of cut in inches/revolution at which backup cutter 128B begins to engage the formation ($CDOC_b$) may be calculated as follows:

$$CDOC_b=(\delta\times360)/\theta \quad (2a).$$

If the depth of cut (COD) of fixed-cutter drill bit 101 is greater than $CDOC_b$, then backup cutter 128B will engage the formation. Otherwise, backup cutter 128B will not engage the formation. $CDOC_b$ and thus whether backup cutter 128B will engage the formation may be calculated solely based on its position with respect to primary cutter 128A. In particular, $CDOC_b$ may be calculated based solely on angle θ, and under-exposure δ.

For some fixed-cutter drill bits, $CDOC_b$ may be constant. As a result, under-exposure δ in inches may be a linear function of θ, as described by the equation:

$$\delta=(CDOC_b\times\theta)/360 \quad (2b).$$

So, for a given $CDOC_b$, it is possible to design a fixed-cutter drill bit with various distances of under-exposure, δ, depending on the angle θ between primary cutter 128A and backup cutter 128B.

In such a bit, if primary cutter 128A never experiences any wear, then primary cutter 128A always remains a major cutter and backup cutter 128B always remains a minor cutter. However, typically the purpose of including backup cutters is to share cutting responsibility when the primary cutter experiences wear. As a result, methods of designing a fixed-cutter drill bit typically account for cutter wear in addition to cutter placement.

Any of various methods of modeling cutter wear may be used in connection with the present disclosure. For example, in models for polycrystalline diamond compact (PDC) cutters based on single cutter tests, cutter wear is proportional to cutter load, cutting velocity, and temperature. Such models may further be incorporated into bit-level models that further account for a cutter's position on a fixed-cutter drill bit. Typically cutter wear models used in connection with this disclosure will have been verified through laboratory testing.

For example, models may be used to determine cutter wear. Other models may be used to determine cutter wear, taking into account the cutter's position on the fixed-cutter drill bit. An example graph of cutter wear along a bit profile for a fixed-cutter drill bit calculated using a cutter wear model is provided in FIG. 8. The average bit dull in this bit profile is 2 out of 8. An example graph of changes to cutting edges during cutter wear on a fixed-cutter drill bit as calculated using a cutter wear model is provided in FIG. 9. Sharp and worn cutting edges are both depicted.

$CDOC_b$ varies as a function of wear, w, of primary cutter 128A. The effects of this may be accounted for in a modified equation similar to equation 2a above:

$$CDOC_b=((\delta-w)\times360)/\theta \quad (2c).$$

Wear of primary cutter 128A, w, is also depicted in FIG. 7, right panel. When wear of the primary cutter 128A, w, is equal to the under-exposure of backup cutter 128B, 6, then $CDOC_b$ is zero and backup cutter 128B functions as an active cutter. Thus, it is possible to design a fixed-cutter drill bit 101 such that backup cutter 128B begins to function as an active cutter at a given wear, w, of primary cutter 128A.

Calculations of $CDOC_b$ may be more complex than in equation 2c due to overlap of neighboring cutters. Various models, which are typically computer-implemented, may be used to calculate $CDOC_b$. Specifically, a prediction of cutting element wear from drilling information may be made using a cutter wear model.

Typically, a fixed-cutter drill bit 101 with track-set primary cutter 128A and backup cutter 128B is designed such that backup cutter 128B does not engage the formation when primary cutter 128A has not experienced any wear, or has experienced only minimal wear, or when the depth of cut (DOC) of the fixed-cutter drill bit 101 has not exceeded a certain value. Such a bit is also typically designed so that when primary cutter 128A has experienced wear, w, that is equal to the under-exposure of backup cutter 128B, δ, backup cutter B becomes a major cutter to allow use of its sharper cutting edge. In order for cutter 128B to become a major cutter, angle θ, is 180 degrees or greater.

Figure 10:
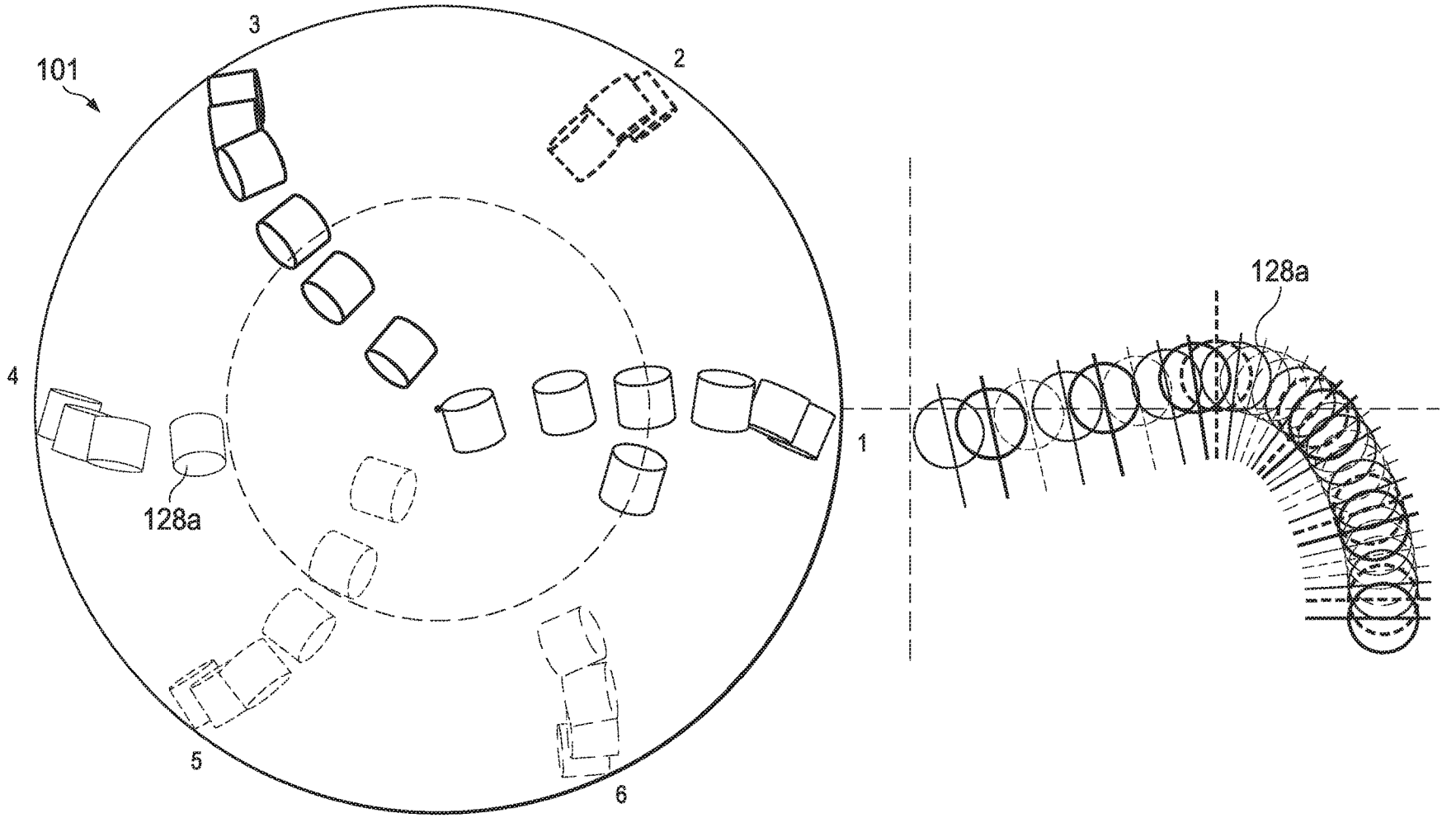
FIG. 10 is a schematic diagram of primary cutters on a fixed-cutter drill bit prior to a design method to place track-set backup cutters.

In another example of designing a fixed-cutter drill bit 101 for drilling a wellbore, a bit similar to that of FIG. 5 is depicted in FIG. 10. This bit may be, for example an 8¾ PDC bit with 6 blades and 16 mm primary cutters. Primary cutter 128A as used in this example is located on blade 4 at the downhole end 151 of fixed-cutter drill bit 101. Example parameters may be used to guide the placement of backup cutter 128B. Backup cutter 128B should not engage the formation when the depth of cut (DOC) of fixed-cutter drill bit 101 is less than 0.1666 inches/revolution, at a rate of penetration (ROP) of 100 feet/hour and a rotations per minute (RPM) of 120. Therefore $CDOC_b$ is 0.16666 inches/revolution. However, backup cutter 128B should engage the formation when primary cutter 128A experiences wear, w, of 0.1 inches. Primary cutter 128A and backup cutter 128B are track set and are the same size.

If backup cutter 128B is located on blade 4, just behind primary cutter 128A located also on blade 4, with an angle θ of 18.86 degrees, its under-exposure, δ, is 0.0087 inches. Thus, backup cutter 128B will begin to engage the formation too soon, before primary cutter 128A has experienced 0.1 inches of wear. In addition, backup cutter 128B will never function as a major cutter. This is not an optimized placement of backup cutter 128B given the bit design parameters.

If backup cutter 128B is located one blade behind the primary cutter, blade 3, with an angle θ of 77.79 degrees, its under-exposure, δ, is 0.0036 inches. Thus, backup cutter 128B will begin to engage the formation too soon, before primary cutter 128A has experienced 0.1 inches of wear. In addition, backup cutter 128B will never function as a major cutter. This is not an optimized placement of backup cutter 128B given the bit design parameters.

If backup cutter 128B is located two blades behind the primary cutter, blade 2, its under-exposure, δ, is 0.0665 inches. Thus, backup cutter 128B will begin to engage the formation too soon, before primary cutter 128A has experienced 0.1 inches of wear. In addition, backup cutter 128B will never function as a major cutter. This is not an optimized placement of backup cutter 128B given the bit design parameters.

If backup cutter 128B is located three blades behind the primary cutter, blade 1, with an angle θ of 203.77 degrees, its under-exposure, δ, is 0.0943 inches. Thus, backup cutter 128B will begin to engage the formation slightly too soon, before primary cutter 128A has experienced 0.1 inches of wear, but because δ in this case is close to w, then engaging slightly too soon may be acceptable. In addition, due to its angle θ, backup cutter 128B will function as a major cutter when primary cutter 128A experiences wear, w, of 0.0943 inches. This may be an optimized placement of backup cutter 128B given the bit design parameters, provided that it is acceptable for backup cutter 128B to engage the formation when primary cutter 128A has experiences slightly less wear than selected.

If backup cutter 128B is located four blades behind the primary cutter, blade 6, with an angle θ of 265.14 degrees, its under-exposure, δ, is 0.1227 inches. Thus, backup cutter 128B will begin to engage the formation when primary cutter 128A has experienced 0.1227 inches of wear, but because δ in this case is close to w, then engaging slightly later than selected may be acceptable. In addition, due to its angle θ, backup cutter 128B will function as a major cutter when primary cutter 128A experiences wear, w, of 0.1227 inches. This may be an optimized placement of backup cutter 128B given the bit design parameters, provided that it is acceptable for backup cutter 128B to engage the formation when primary cutter 128A has experiences slightly more wear than selected.

If backup cutter 128B is located on five blades behind the primary cutter, blade 5, with an angle θ of 329.23 degrees, its under-exposure, δ, is 0.1524 inches. Thus, backup cutter 128B will only begin to engage the formation when primary cutter 128A has experienced 0.1524 inches of wear, which is too great as compared to the selected wear of 0.1 inches. Due to its angle θ, backup cutter 128B will function as a major cutter when primary cutter 128A experiences wear, w, of 0.1524 inches. This is still not an optimized placement of backup cutter 128B given the bit design parameters because the under-exposure, δ, is too large.

Figure 11:
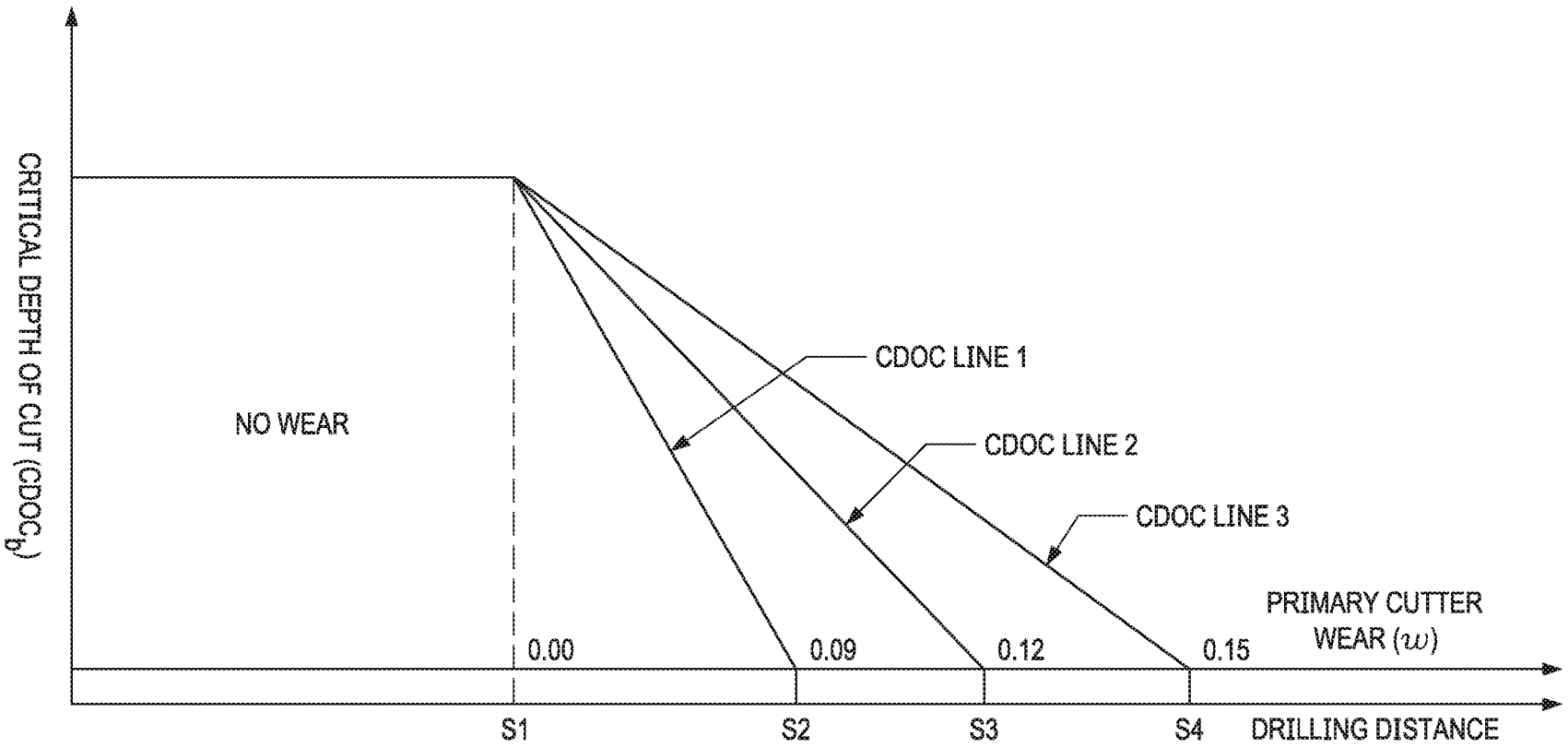
FIG. 11 is graph of critical depth of cut of a backup cutter ($CDOC_b$) as a function of primary cutter wear (w) and drilling distance.
Figure 12:
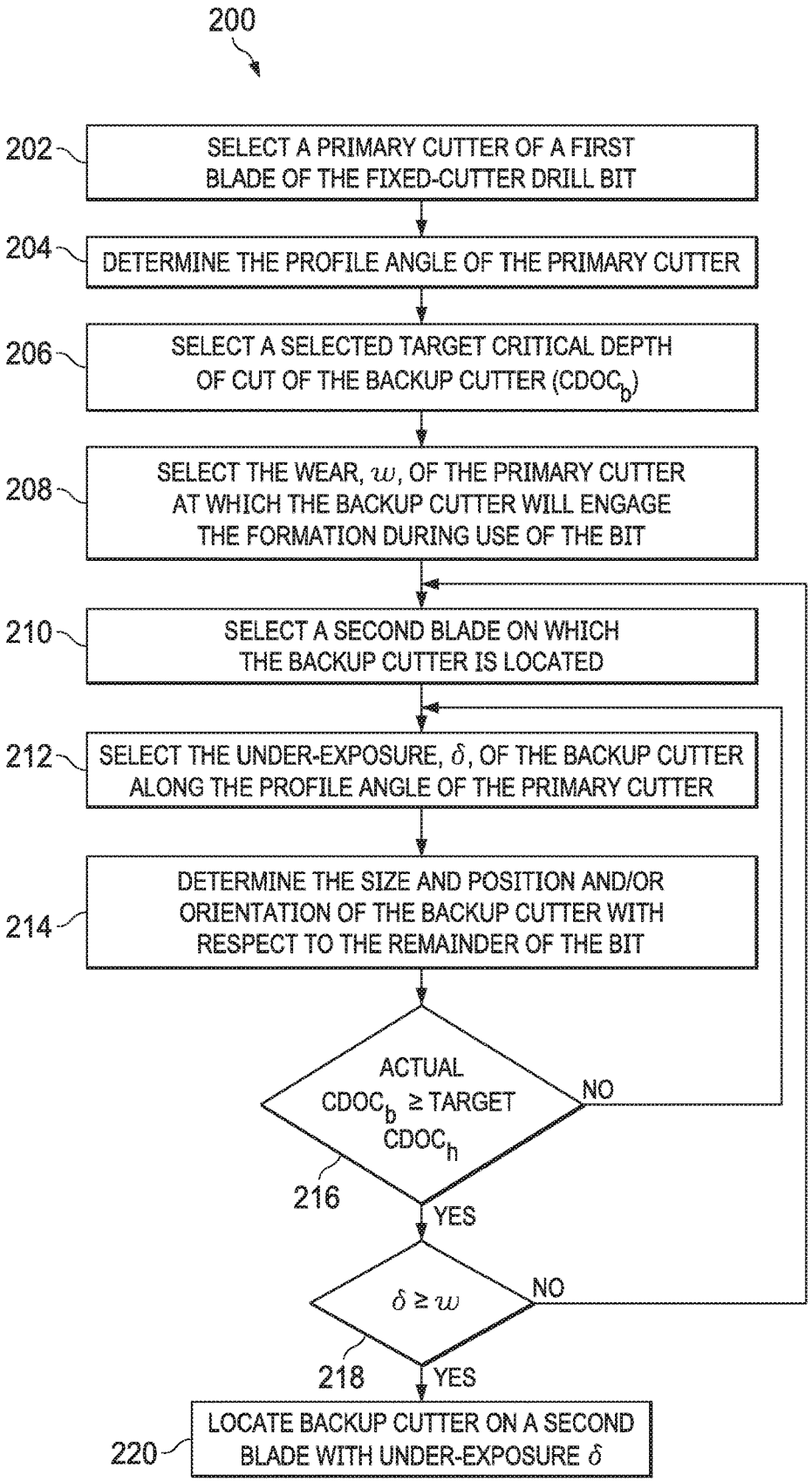
FIG. 12 is a flow chart of a method for designing a fixed-cutter drill bit having primary cutters and track-set backup cutters.

The optimal placement of backup cutter 128B may be further evaluated. FIG. 11 is graph of critical depth of cut as a function of cutter wear and drilling distance and is useful in this further evaluation.

If backup cutter 128B is placed three blades behind the primary cutter, then $CDOC_b$ will follow $CDOC_b$ line 1 in FIG. 11. From drilling distance 0 to drilling distance to S1, there is no cutter wear so backup cutter 128B will not engage the formation. From drilling distance S1 to drilling distance S2, $CDOC_b$ decreases to $CDOC_b$ line 2 and the backup cutter 128B will gradually engage the formation. At drilling distance S2, backup cutter 128B becomes a major cutter and engages formation fully. After drilling distance S2, because the angle θ between primary cutter 128A and backup cutter 128B is 203.77 degrees, which is close to 180 degrees, both worn primary cutter 128A and the backup cutter 128B will have nearly equal engagement areas. After drilling distance S2, both primary cutter 128A and backup cutter 128B will act as major cutters and drilling efficiency of both cutters will be improved. Drilling efficiency will particularly be improved in situations where w is small.

If backup cutter 128B is placed four blades behind the primary cutter, then $CDOC_b$ will follow $CDOC_b$ line 2 in FIG. 11. From drilling distance 0 to drilling distance to S1, there is no cutter wear so backup cutter 128B will not engage the formation. From drilling distance S1 to drilling distance S3, $CDOC_b$ decreases to $CDOC_b$ line 3 and the backup cutter 128B will gradually engage the formation. At drilling distance S3, backup cutter 128B becomes a major cutter and engages formation fully. After drilling distance S3, because the angle θ between primary cutter 128A and backup cutter 128B is 265 degrees, backup cutter 128B will become a major cutter and primary cutter 128A will become a minor cutter. Drilling efficiency will be particularly improved by this bit design in situations where w is large.

The principles described herein may be applied in a method 200 of designing a fixed-cutter drill bit 101 for use in drilling a wellbore 114 in a formation. A flow chart of this method is provided in FIG. 12. For illustrative purposes, method 200 is described with respect to a fixed-cutter drill bit 101; however, method 200 may be used to design any fixed-cutter drill bit.

Fixed-cutter drill bit 101 contains at least one pair of track set cutters identified as primary cutter 128A and backup cutter 128B. A fixed-cutter drill bit 101 with multiple pairs of track set cutters 128 may be designed by repeating this method 200 for each pair, or by applying the design for one pair of cutters 128 to similarly positioned cutters 128 subject to similar design parameters.

Fixed cutter-drill bit 101 may be designed according to the principles and methods described herein to both extend bit life and increase ROP. For example, the fixed-cutter drill bit 101 may have a primary cutter 128A located on a first blade 126 and a backup cutter 128B that is track-set with the primary cutter 128A and is located on a second blade 126. Backup cutter 128B may be located on a second blade 126 at an angle, θ, as measured with respect to the bit rotational axis of the bit 104 in a direction opposite the direction 105 in which the bit rotates during use. θ may be greater than or equal to 150 degrees, 180 degrees, or 240 degrees. The backup cutter 128B and may have an under-exposure, δ, along the profile angle of the primary cutter 128A.

The under-exposure, δ, may be zero, in which case θ may be greater than or equal to 180 degrees, or 240 degrees.

Other parameters of fixed-cutter drill bit 101 may also be selected to both extend bit life and increase ROP.

For example, the backup cutter 128B may have a chamfer between the cutting surface 130 and the side surface 132 that has a length less than that of the chamfer of the primary cutter 128A. In particular, the chamfer of backup cutter 128B may have a length less than or equal to 60%, 55%, or 50% of the chamfer of primary cutter 128A.

Furthermore, the chamfer length of both the primary cutter 128A and the backup cutter 128B may be reduced to improve both bit life and ROP. For example, the chamfer length may be 0.010 inch or less, between 0.005 inch and 0.015 inch, between 0.0075 and 0.0125 inch, or between 0.001 inch and 0.010 inch, instead of the more typical 0.020 inch.

In addition, the backup cutter 128B may have a back rake angle that is less than the back rake angle of the primary cutter 128A. In particular the back rake angle of the backup cutter 128B may be at least 2 degrees, at least 5 degrees, or at least 10 degrees less than that of the primary cutter 128A.

Furthermore, the back rake angle of both the primary cutter 128A and the backup cutter 128B may be limited to improve both bit life and ROP. For example, a back rake angle of 15 degrees or less, 10 degrees or less, or 5 degrees or less may be used, particularly if impact damage to the cutter is not a concern.

Other design parameters may further improve bit life an ROP. These include using a reduced number of blades, such as 5 or fewer or 6 or fewer blades, smaller cutters, a multi-level force balanced cutter layout, particularly with paired cutters, and a track-set oppose cutter layout instead of a track-set leading or trailing cutter layout.

Method 200 may be performed on an incomplete bit design for fixed-cutter drill bit 101. The incomplete bit design may include a bit body 124 with at least two blades 126 and having a bit rotational axis 104 about with the bit rotates in a direction 105 during use. The bit design may also include a primary cutter 128A located on a first blade 126 and having a profile angle. The primary cutter 128A is a major cutter at onset of use of the bit. The backup cutter 128B whose location is to be determined may be track-set with the primary cutter 128A and may have an under-exposure, δ, along the profile angle of the primary cutter. The backup cutter 128B may be located on a second blade 126 at an angle, θ, as measured with respect to the bit rotational axis of the bit 104 in a direction opposite the direction 105 in which the bit rotates during use. θ may be greater than or equal to 150 degrees.

In step 202 primary cutter 128A on blade 126 of fixed-cutter drill bit 101 is selected as the basis for placement of backup cutter 128B on a different blade of fixed-cutter drill bit 101.

In step 204, the profile angle of primary cutter 128A is determined. The profile angle may form the basis for later wear calculations and under-exposure calculations.

In step 206, a selected target critical depth of cut of backup cutter 128B, selected target $CDOC_b$, is determined. Selected target $CDOC_b$ is such that, when the depth of cut (DOC) of the primary cutter 128A is less than selected target $CDOC_b$, backup cutter 128B does not engage the formation.

In step 208, wear, w, of primary cutter 128A is selected. Wear, w, is selected so that, when the primary cutter has experienced wear to a depth of w, the backup cutter engages the formation and begins to function as a major cutter. At such time, the backup cutter may be the only major cutter, with the primary cutter becoming a minor cutter, or the backup cutter and the primary cutter may both be major cutters.

In step 210, a blade is selected for backup cutter 128B, such an angle, θ, between a point Pa on primary cutter 128A and a point Pb on backup cutter 128B, as measured with respect to the bit rotational axis 104 of the fixed-cutter drill bit 101 and in the direction opposite the direction 105 of rotation of the drill bit, is greater than or equal to 150 degrees or 180 degrees. Thus, backup cutter 128B is rotationally 150 degrees or 180 degrees or greater behind primary cutter 128A.

In step 212, an under-exposure, δ, of backup cutter 128B is selected. The under-exposure is along the profile angle for primary cutter 128A that was determined in step 204.

In step 214, the size and position and/or orientation of backup cutter 128B with respect to the remainder of fixed-cutter drill bit 101 is determined.

In step 216, the actual critical depth of cut of backup cutter 128B, actual $CDOC_b$, is calculated using equation 2a or equation 2c.

In step 218, actual $CDOC_b$ is compared to the selected target $CDOC_b$ of step 206. If the actual $CDOC_b$ of step 216 is not greater than or equal to the selected target $CDOC_b$ of step 206, then step 212 is repeated, with a different under-exposure, δ, of backup cutter 128B selected. If the actual $CDOC_b$ of step 216 is greater than or equal to the selected target $CDOC_b$ of step 206, then the method proceeds to step 218.

In step 218, the selected under-exposure, δ, of step 212 is compared to the selected wear, w, of step 208. If the selected under-exposure, δ, of step 212 is not greater than or equal to the selected wear, w, of step 208, then step 210 is repeated, with a different blade being selected for backup cutter 128B, changing angle θ. If the selected under-exposure, δ, of step 212 is greater than or equal to the selected wear, w, of step 208, then in step 220 backup cutter 128B is placed on the blade selected in step 210 at the angle, θ, also dictated by step 210, in a position track-set with primary cutter 128A and with an under-exposure, δ, as selected in step 212, with respect to the profile angle of primary cutter 128A.

Method 200 may be accomplished using the bit and cutter information identified above. Additional methods may be used to design other aspects of fixed-cutter drill bit 101, including other aspects of cutter 128 identity, size, and relative placement. These other methods may be combined with method 200 individually, or in any and all possible combinations of one another with method 200. In addition, these methods may be performed before or after method 200, or between steps of method 200.

For example, in addition to the steps of method 200, the length of the chamfer of the primary cutter 128A and of the backup cutter 128B may be determined and compared to determine if the length of the chamfer of the backup cutter 128B is less than that of the primary cutter 128A. If it is not, then the primary cutter 128A, the backup cutter 128B, or both may be replaced so that the chamfer of the backup cutter 128B is less than that of the primary cutter 128A.

Also in addition to the steps of method 200, the back rake angle of the primary cutter 128A and of the backup cutter 128B may be determined and compared to determine if the back rake angle of the backup cutter 128B is less than that of the primary cutter 128A. If it is not, then the back rake angle of the primary cutter 128A, the backup cutter 128B, or both may be adjusted so that the back rake angle of the backup cutter 128B is less than that of the primary cutter 128A. Such an adjustment may affect the CDOD such that this method may be performed prior to method 200, or a step in method 200 relating to CDOC, such as step 206, 214, or 216.

The steps of method 200 may be performed by various computer programs, models or any combination thereof, configured to simulate and design drilling systems, apparatuses and devices. The programs and models may include instructions stored on a computer readable medium and operable to perform, when executed, one or more of the steps described below. The computer readable media may include any system, apparatus or device configured to store and retrieve programs or instructions such as a hard disk drive, a compact disc, flash memory or any other suitable device. The programs and models may be configured to direct a processor or other suitable unit to retrieve and execute the instructions from the computer readable media.

Collectively, the computer programs and models used to simulate and design drilling systems may be referred to as a "drilling engineering tool" or "engineering tool." Due to the simplicity of method 200 as compared to other methods for designing the same or similar aspects of fixed-cutter drill bit 101, the performance of such drilling engineering tools may be improved, for example by allowing bit design in less time or using less complex hardware.

In an embodiment A, the present disclosure provides a fixed-cutter drill bit including a bit body having at least two or at least three blades and having a bit rotational axis about with the bit rotates in a direction during use, a primary cutter located on a first blade and having a profile angle, in which the primary cutter is a major cutter at onset of use of the bit, and a backup cutter track set with the primary cutter and having an under-exposure, δ, along the profile angle of the primary cutter, the backup cutter located on a second blade at an angle, θ, as measured from the primary cutter with respect to the bit rotational axis of the bit in a direction opposite the direction in which the bit rotates during use, in which θ is greater than or equal to 150 degrees.

The present disclosure further provides in embodiment B a system for drilling a wellbore in a formation in which the system includes a drill string, a fixed-cutter drill bit as described in embodiment A attached to the drill string, and a surface assembly to rotate the drill string and bit during use of the bit to drill a wellbore in a formation.

In a third embodiment C, the disclosure provides a method including providing an incomplete bit design including a bit body having at least two or at least three blades and having a bit rotational axis about which the bit rotates in a direction during use, a primary cutter located on a first blade and having a profile angle, in which the primary cutter is a major cutter at onset of use of the bit, and determining a location of a backup cutter track set with the primary cutter and having an under-exposure, δ, along the profile angle of the primary cutter, the backup cutter located on a second blade at an angle, θ, as measured from the primary cutter with respect to the bit rotational axis of the bit in a direction opposite the direction in which the bit rotates during use, wherein θ is greater than or equal to 150 degrees. Determining the location of the backup cutter includes selecting a primary cutter on the first blade; determining the profile angle of the primary cutter; selecting a selected target critical depth of cut of the backup cutter ($CDOC_b$); selecting the wear, w, of the primary cutter at which the backup cutter will engage a formation during use of the bit; selecting a second blade for the backup cutter such that the angle, θ, based on this selection is greater than or equal to 150 degrees; selecting the under-exposure, δ, of the backup cutter along the profile angle of the primary cutter; calculating an actual $CDOC_b$ for the backup cutter using one of the following equations: $CDOC_b=((\delta-w)\times360)/\theta$ or $CDOC_b=(w\times360)/\theta$; and comparing the actual $CDOC_b$ to the selected target $CDOC_b$ and if the actual $CDOC_b$ is not greater than or equal to the selected target $CDOC_b$, repeating the selecting the under-exposure, δ, step and subsequent steps with a different under-exposure, δ, or if the actual $CDOC_b$ is greater than or equal to the target $CDOC_b$, comparing the selected under-exposure, δ, to the selected wear, w, and, if the selected under-exposure, δ, is not greater than or equal to the selected wear, w, repeating the selecting a second blade step and subsequent steps with a different second blade, or if the selected under-exposure, δ, is greater than or equal to the selected wear, w, locating the backup cutter on the second blade at the angle, θ, with the under-exposure, δ.

The present disclosure, in an embodiment D, provides a drilling engineering tool including instructions stored on a computer readable medium and operable to perform, when executed, the method of designing a fixed-cutter drill of embodiment C.

Embodiments A, B, C and D may be further characterized by the following additional features, which may be combined with one another unless clearly mutually exclusive:

i) in embodiments A and B, the location of the backup cutter on the bit may be determined by selecting a primary cutter on the first blade, determining the profile angle of the primary cutter, selecting a selected target critical depth of cut of the backup cutter ($CDOC_b$), selecting the wear, w, of the primary cutter at which the backup cutter will engage a formation during use of the bit, selecting a second blade for the backup cutter such that the angle, θ, based on this selection is greater than or equal to 150 degrees, and selecting the under-exposure, δ, of the backup cutter along the profile angle of the primary cutter;

ii) in embodiments A and B, the location of the backup cutter on the bit may also be determined by calculating an actual $CDOC_b$ for the backup cutter using one of the following equations: $CDOC_b=((\delta-w)\times360)/\theta$ or $CDOC_b=(w\times360)/\theta$, and comparing the actual $CDOC_b$ to the selected target $CDOC_b$ and if the actual $CDOC_b$ is not greater than or equal to the selected target $CDOC_b$, repeating the selecting the under-exposure, δ, step and subsequent steps with a different under-exposure, δ, or if the actual $CDOC_b$ is greater than or equal to the target $CDOC_b$, comparing the selected under-exposure, δ, to the selected wear, w, and, if the selected under-exposure, δ, is not greater than or equal to the selected wear, w, repeating the selecting a second blade step and subsequent steps with a different second blade, or if the selected under-exposure, δ, is greater than or equal to the selected wear, w, locating the backup cutter on the second blade at the angle, θ, with the under-exposure, δ;

iii) the angle, θ, may be between 150 and 210 degrees and the backup cutter may become a major cutter during use of the bit and the primary cutter may remain a major cutter while the backup cutter is also a major cutter;

iv) the angle, θ, may be 180 degrees or greater;

v) the angle, θ, may be between 180 and 210 degrees and the backup cutter may become a major cutter during use of the bit and the primary cutter may remain a major cutter while the backup cutter is also a major cutter;

vi) the angle, θ, may be between 210 and 330 degrees, the backup cutter may become a major cutter during use of the bit, and the primary cutter may become a minor cutter while the backup cutter is a major cutter;

vii) the angle, θ, is between 210 and 250 degrees, the backup cutter may become a major cutter during use of the bit, and the primary cutter may become a minor cutter while the backup cutter is a major cutter;

viii) the drilling engineering tool may operable to perform the method, resulting in locating the backup cutter, more quickly than the drilling engineering tool is operable to perform another method of locating the backup cutter, wherein the other method comprises additional steps;

ix) the method may include manufacturing a drill bit according to the incomplete drill bit design with the backup cutter located on the second blade at the angle, θ, with the under-exposure, δ.

EXAMPLES

The following example presents data from field use of a fixed-cutter drill bit designed according to the principles presented herein. The example is not intended to be and should not be interpreted as encompassing the entirety of the disclosure.

In the Rahaya field in West Kuwait, a 9¼ inch vertical wellbore was drilled in Zubair abrasive sandstone (approximately 1,100 feet), Ratawi Shale, and Ratawi Limestone formations, with a total interval length of 2,160 feet (from 9,490 to 11,650 feet). Historically, at least two fixed-cutter PDC drill bits were required to drill this challenging interval; a highly durable drill bit to drill through the Zubair sandstone and another more aggressive drill bit to drill the Ratawi Shale and Ratawi Limestone.

A detailed study of the drill bit performances from offset wells showed that cutters within the nose and shoulder zones of the first drill bit, which drilled through the Zubair sandstone, exhibited wear. The cutting structure of the second drill bit, which drilled through the Ratawi Shale and Ratawi Limestone, was properly designed. To reduce cost, one fixed-cutter PDC drill bit with backup cutters was designed according to the present disclosure.

The $CDOC_b$ for all backup cutters was set at 0.045 inches/revolution. At 120 rotations per minute (RPM), no backup cutters would engage the formation if the bit penetration rate was less than or equal to 27 feet/hour. Backup cutters in nose and shoulder regions of the fixed-cutter drill bit were designed to engage the formation when primary cutter wear, w, was between 0.023 and 0.026 inches.

Figure 13:
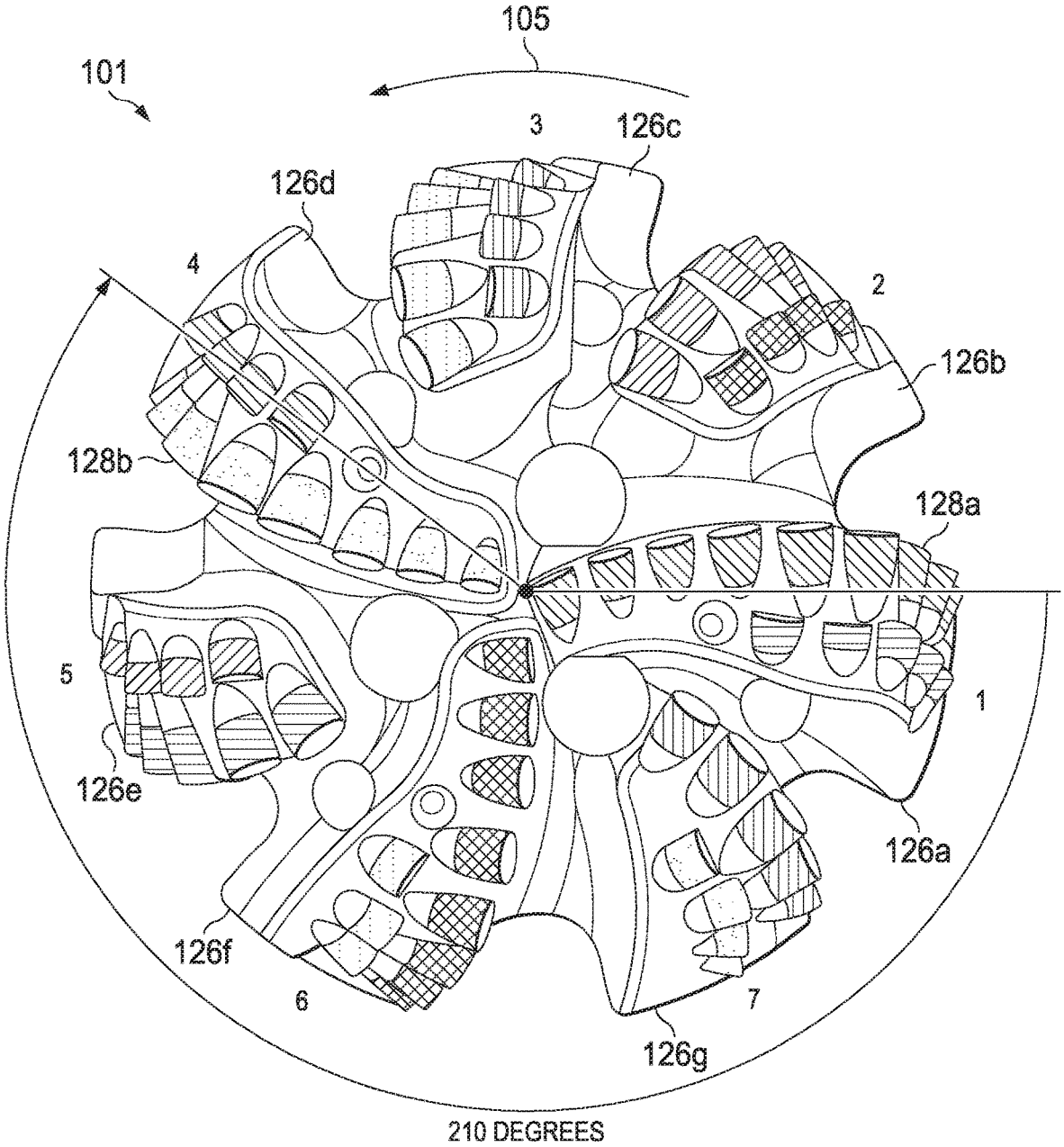
FIG. 13 is a schematic diagram of a fixed-cutter drill bit with primary cutters and track-set backup cutters.
Figure 14:
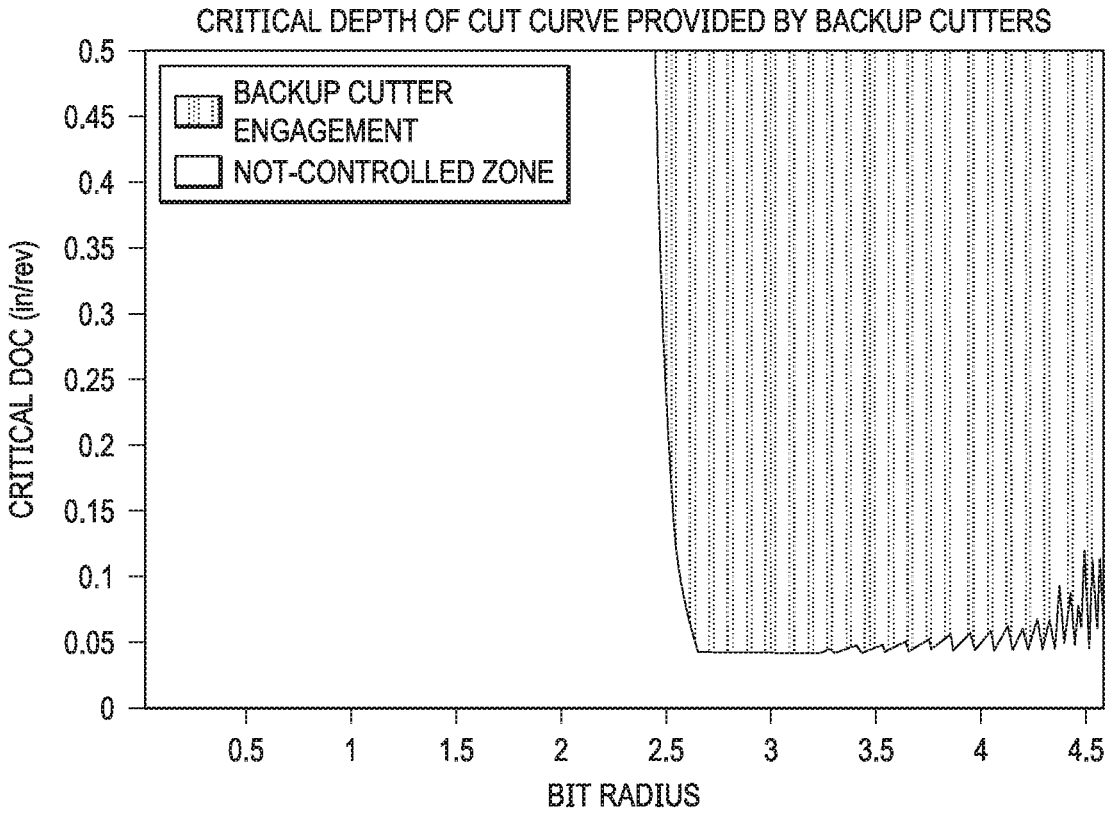
FIG. 14 is a graph of critical depth of cut of backup cutters ($CDOC_b$) as a function of bit radius for the fixed-cutter drill bit of FIG. 13.

The fixed-cutter drill bit 101, as illustrated in FIG. 13, contained seven blades, with all backup cutters located four blades rotationally behind their primary cutters. One pair of cutters, primary cutter 128A and backup cutter 128B are labeled in FIG. 13 to illustrate the respective placements. The $CDOC_b$ for the backup cutters was calculated and is graphed in FIG. 14. As FIG. 14 shows, almost all backup cutters had the same critical depth of cut of 0.045 in/rev, so that almost all backup cutters engaged the formation simultaneously.

Figure 15:
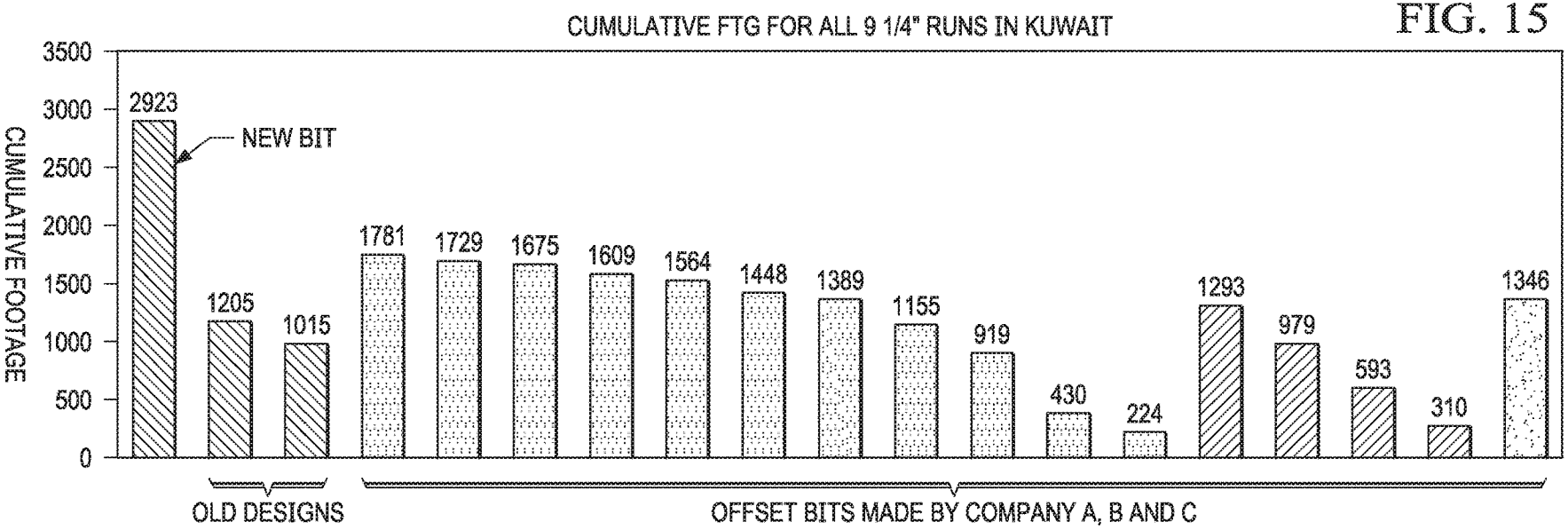
FIG. 15 is a graph of drilling distance achieved with the fixed-cutter drill bit of FIG. 13 (labeled "new bit") as compared with other fixed-cutter drill bits that are not designed according to the present disclosure.
Figure 16:
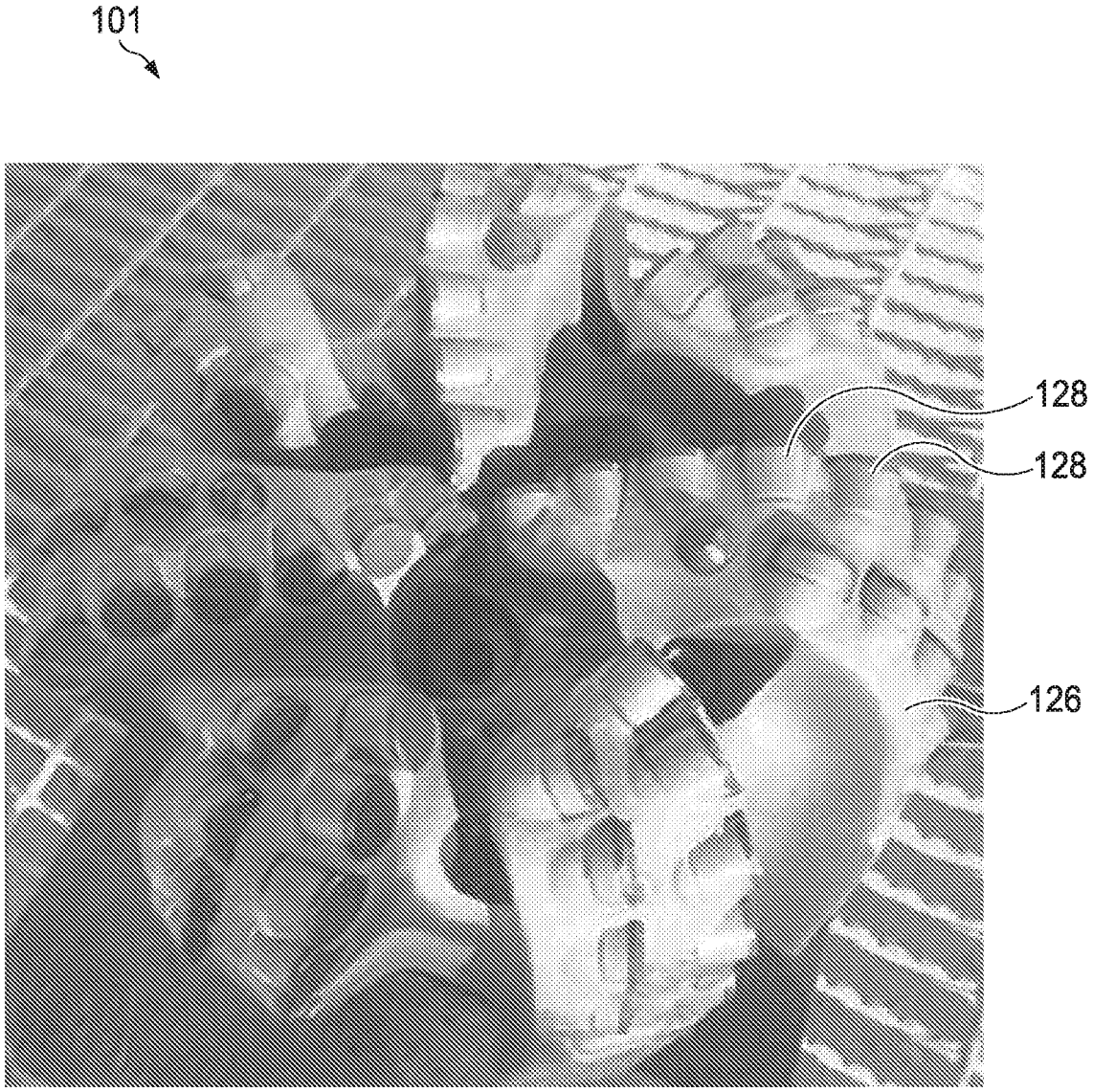
FIG. 16 is a photograph of the bit of FIG. 13 after use, in a dull condition.
Figure 17:
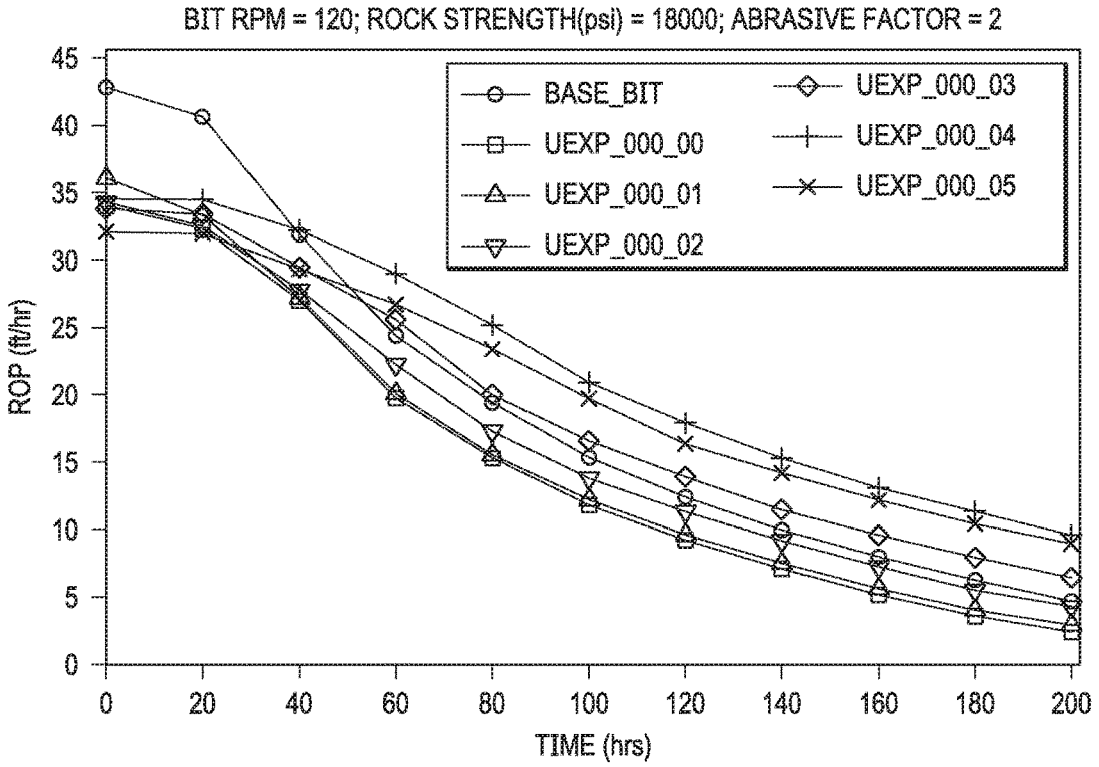
FIG. 17 is a graph of rate of penetration (ROP) with a fixed-cutter drill with six blades and with primary cutters and track-set backup cutters with the track-set backup cutter located on various blades.
Figure 18:
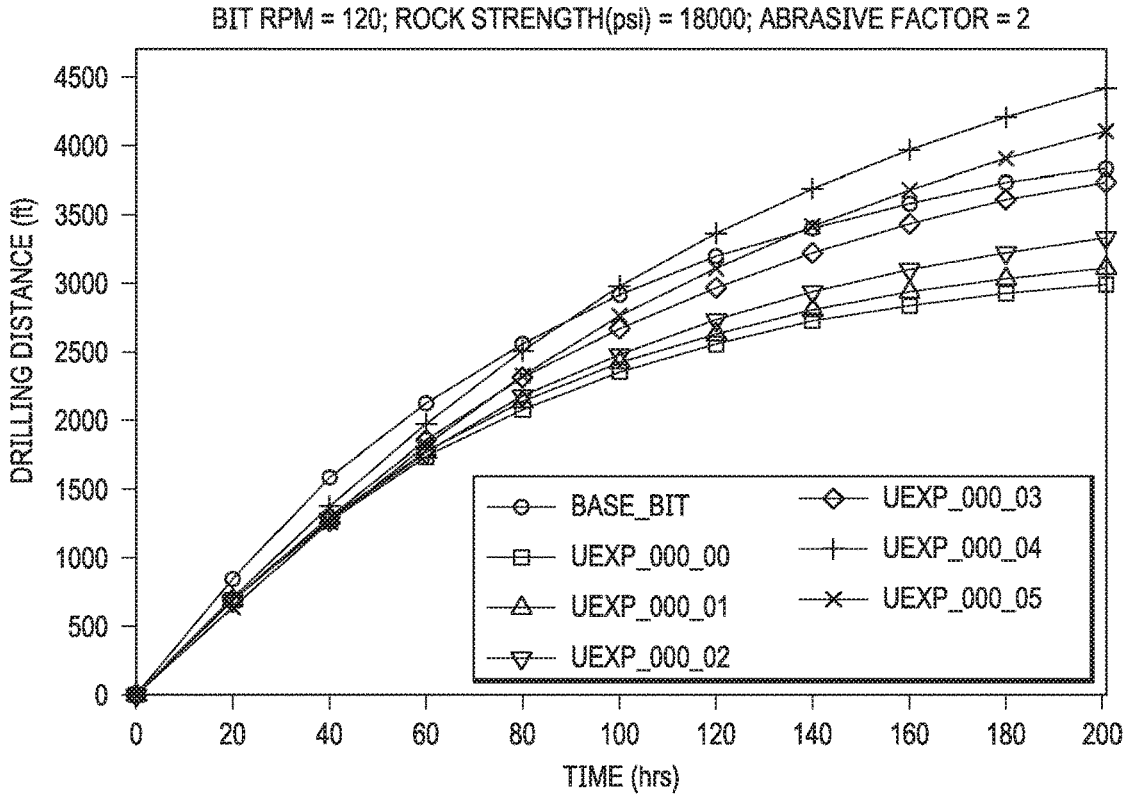
FIG. 18 is a graph of drilling distance with a fixed-cutter drill with six blades and with primary cutters and track-set backup cutters with the track-set backup cutter located on various blades.
Figure 19:
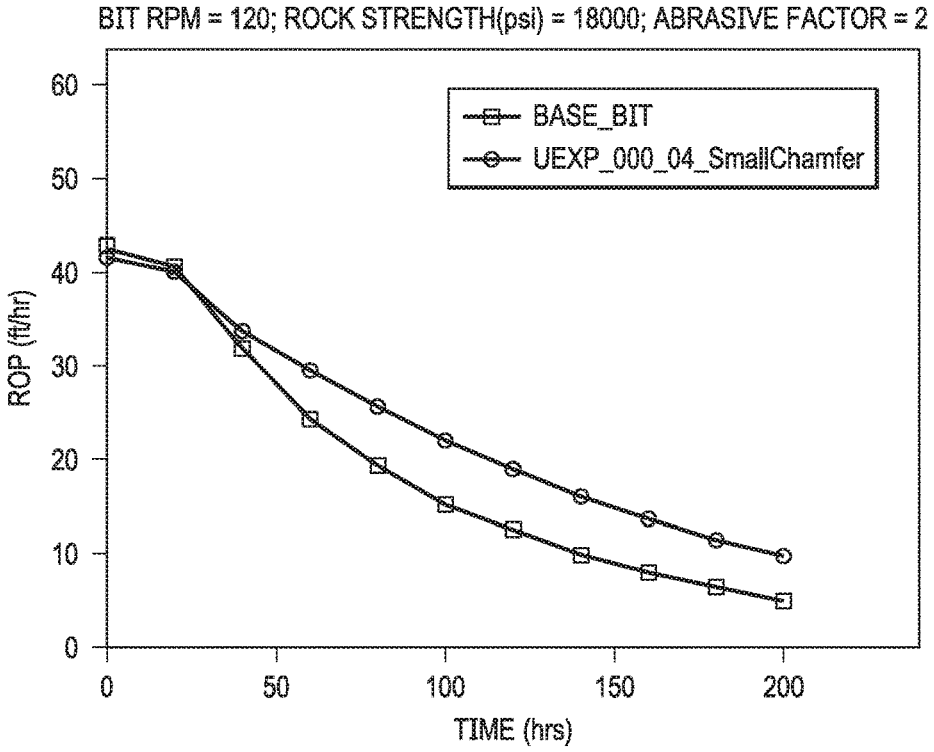
FIG. 19 is a graph of ROP with a fixed-cutter drill with six blades and with primary cutters and track-set backup cutters with the track-set backup cutter located four blades rotationally behind the primary cutter and having a chamfer smaller than that of the primary cutter.
Figure 20:
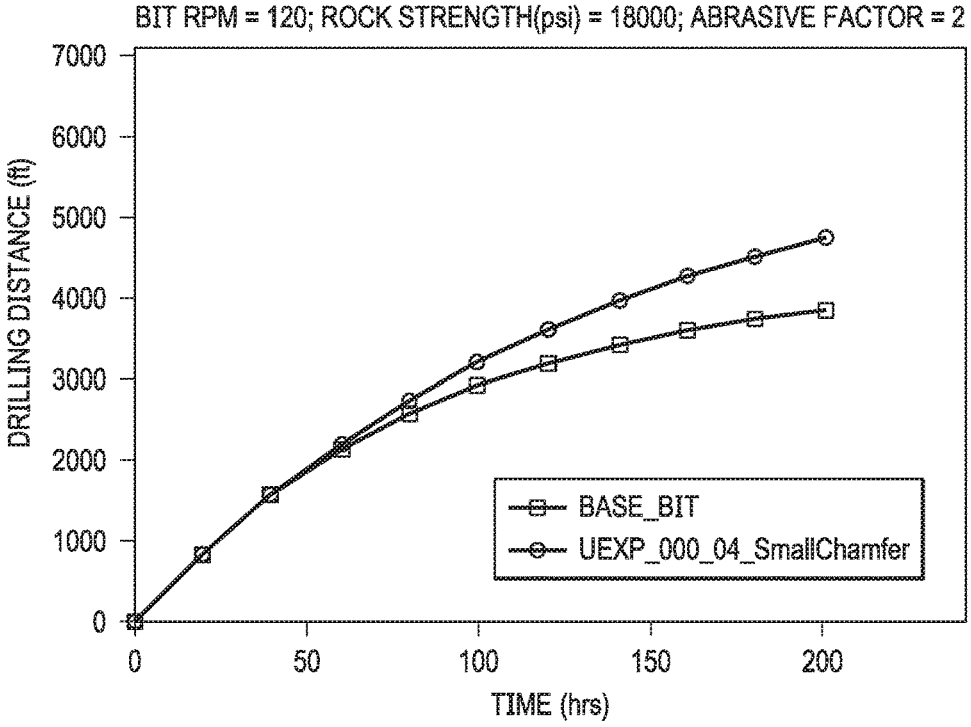
FIG. 20 is a graph of drilling distance with a fixed-cutter drill with six blades and with primary cutters and track-set backup cutters with the track-set backup cutter located on four blades rotationally behind the primary cutter and having a chamfer smaller than that of the primary cutter.
Figure 21:
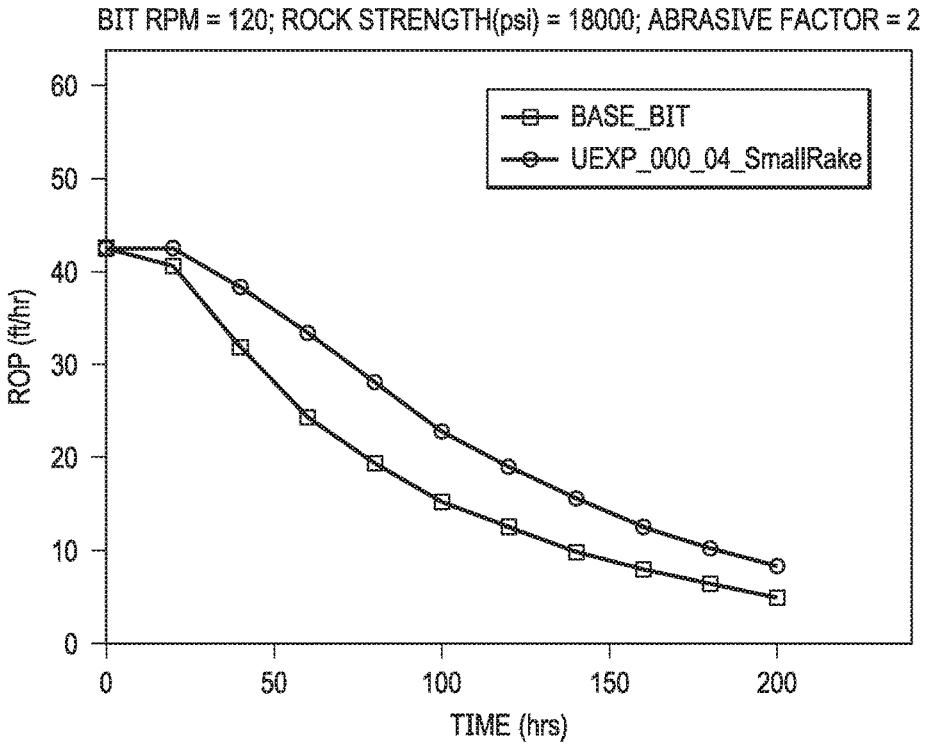
FIG. 21 is a graph of ROP with a fixed-cutter drill with six blades and with primary cutters and track-set backup cutters with the track-set backup cutter located four blades rotationally behind the primary cutter and having a smaller back rake angle than the primary cutter.
Figure 22:
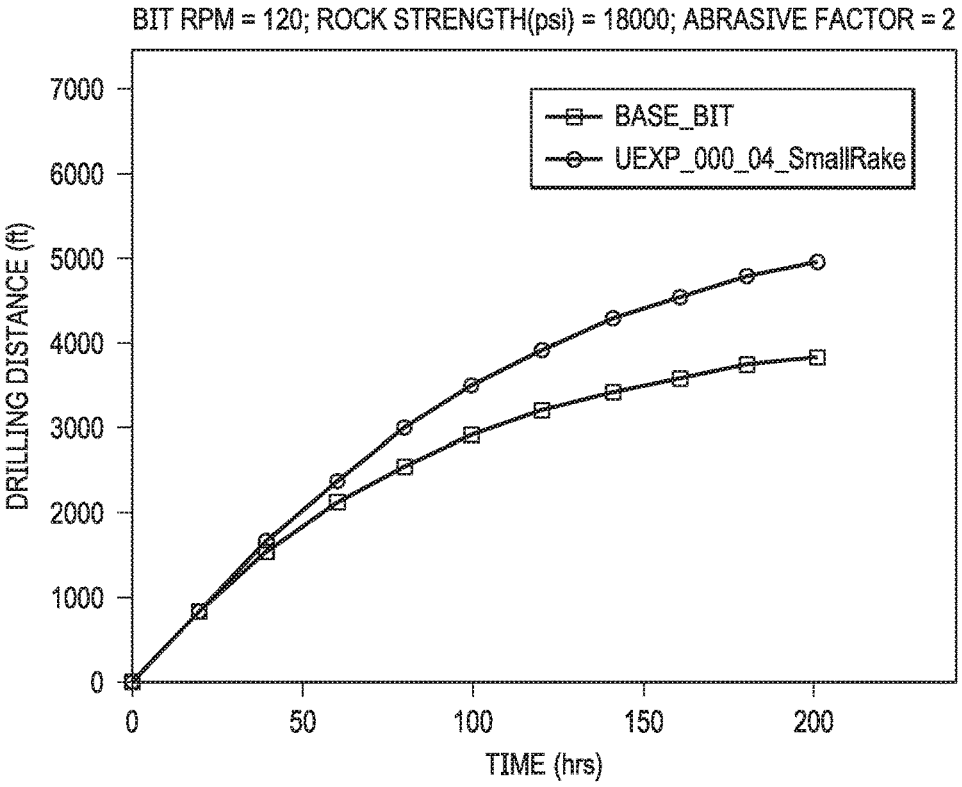
FIG. 22 is a graph of drilling distance with a fixed-cutter drill with six blades and with primary cutters and track-set backup cutters with the track-set backup cutter located four blades rotationally behind the primary cutter and having a smaller back rake angle than the primary cutter.

FIG. 15 presents a comparison of the fixed-cutter drill bit of FIG. 13 to other bits used to drill the same formations. The drill bit drilled a total distant of 2923 feet, which was the longest footages obtained in the Rahaya field in West Kuwait. The drill bit drilled through the Zubair abrasive sandstone formation, the Ratawi Shale formation, the Ratawi Limestone formation and the entire Minagish formations with an average rate of penetration (ROP) of 19.84 feet/hour, faster than most of the offset bits also tested. FIG. 16 shows the dull condition of the fixed-cutter drill bit after drilling.

A fixed-cutter drill bit 101 having six blades 126, a primary cutter 128A on a first blade 126, and a track-set backup cutter 128B on a second blade 126 with an under-exposure, δ, of zero was used to drill a formation. The effect of blade location for the backup cutter 128B on ROP is presented in FIG. 17. The effect of blade location for the backup cutter 128B on drilling distance is presented in FIG. 18. In both instances, placement of the backup cutter four blades rotationally behind the primary cutter, corresponding to an angle, θ of approximately 240 degrees, provided optimal results. Improved results were also observed for placement five blades rotationally behind the primary cutter, to an angle, θ, of 300 degrees.

A fixed-cutter drill bit 101 having six blades 126, a primary cutter 128A on a first blade 126, and a track-set backup cutter 128B on a second blade 126 with an under-exposure, δ, of zero, and an angle θ of 240 degrees, was used to drill a formation. The primary cutter 128A had a chamfer of 0.018 inch, while the secondary cutter 128B had a chamfer of 0.010 inch. The effect on ROP is presented in FIG. 19. The effect on drilling distance is presented in FIG. 20.

A fixed-cutter drill bit 101 having six blades 126, a primary cutter 128A on a first blade 126, and a track-set backup cutter 128B on a second blade 126 with an under-exposure, δ, of zero, and an angle θ of 240 degrees, was used to drill a formation. The primary cutter 128A had a back rake angle of 20 degrees, while the backup cutter 128B had a back rake angle of 15 degrees. The effect on ROP is presented in FIG. 21. The effect on drilling distance is presented in FIG. 22.

Although the present disclosure and its advantages have been described in detail, it should be understood that various changes, substitutions and alternations can be made herein without departing from the spirit and scope of the disclosure as defined by the following claims. For example, although the present disclosure describes the configurations of blades and cutting elements with respect to drill bits, the same principles may be used to control the depth of cut of any suitable drilling tool according to the present disclosure. It is intended that the present disclosure encompasses such changes and modifications as fall within the scope of the appended claims.

What is claimed is:

1. A fixed-cutter drill bit comprising:

a bit body comprising at least two blades and having a bit rotational axis about which the bit rotates in a direction during use;

a primary cutter located on a first blade and having a profile angle, wherein the primary cutter is a major cutter at onset of use of the bit; and a backup cutter track set with the primary cutter and having an under-exposure, δ, along the profile angle of the primary cutter, the backup cutter located on a second blade at an angle, θ, as measured from the primary cutter with respect to the bit rotational axis of the bit in a direction opposite the direction in which the bit rotates during use, wherein θ is greater than or equal to 150 degrees, wherein the location of the backup cutter on the bit is determined by:

selecting a primary cutter on the first blade;

determining the profile angle of the primary cutter;

selecting a selected target critical depth of cut of the backup cutter ($CDOC_b$);

selecting the wear, w, of the primary cutter at which the backup cutter will engage a formation during use of the bit;

selecting a second blade for the backup cutter such that the angle, θ, based on this selection is greater than or equal to 150 degrees;

selecting the under-exposure, δ, of the backup cutter along the profile angle of the primary cutter.

2. The fixed-cutter drill bit of claim 1, wherein the location of the backup cutter on the bit is further determined by:

calculating an actual $CDOC_b$ for the backup cutter using one of the following equations:

$$CDOC_b=((\delta-w)\times 360)/\theta \text{ or } CDOC_b=(w\times 360)/\theta; \text{ and}$$

comparing the actual $CDOC_b$ to the selected target $CDOC_b$ and if the actual $CDOC_b$ is not greater than or equal to the selected target $CDOC_b$, repeating the selecting under-exposure, δ, step and subsequent steps with a different under-exposure, δ, or if the actual $CDOC_b$ is greater than or equal to the target $CDOC_b$, comparing the selected under-exposure, δ, to the selected wear, w, and, if the selected under-exposure, δ, is not greater than or equal to the selected wear, w, repeating the selecting a second blade step and subsequent steps with a different second blade, or if the selected under-exposure, δ, is greater than or equal to the selected wear, w, locating the backup cutter on the second blade at the angle, θ, with the under-exposure, δ.

3. The fixed-cutter drill bit of claim 1, wherein, the angle, θ, is between 150 and 210 degrees and the backup cutter becomes a major cutter during use of the bit and the primary cutter remains a major cutter while the backup cutter is also a major cutter.

4. The fixed-cutter drill bit of claim 1, wherein the angle, θ, is 180 degrees or greater.

5. The fixed-cutter drill bit of claim 1, wherein, the angle, θ, is between 210 and 330 degrees, the backup cutter becomes a major cutter during use of the bit, and the primary cutter becomes a minor cutter while the backup cutter is a major cutter.

6. A system for drilling a wellbore in a formation, the system comprising:

a drill string;

a fixed-cutter drill bit attached to the drill string, the fixed-cutter drill bit comprising:

a bit body comprising at least two blades and having a bit rotational axis about which the bit rotates in a direction during use;

a primary cutter located on a first blade and having a profile angle, wherein the primary cutter is a major cutter at onset of use of the bit; and a backup cutter track set with the primary cutter and having an under-exposure, δ, along the profile angle of the primary cutter, the backup cutter located on a second blade at an angle, θ, as measured from the primary cutter with respect to the bit rotational axis of the bit in a direction opposite the direction in which the bit rotates during use, wherein θ is greater than or equal to 150 degrees, wherein the location of the backup cutter on the bit is determined by:

selecting a primary cutter on the first blade;

determining the profile angle of the primary cutter;

selecting a selected target critical depth of cut of the backup cutter ($CDOC_b$);

selecting the wear, w, of the primary cutter at which the backup cutter will engage a formation during use of the bit;

selecting a second blade for the backup cutter such that the angle, θ, based on this selection is greater than or equal to 150 degrees;

selecting the under-exposure, δ, of the backup cutter along the profile angle of the primary cutter.

7. The system of claim 6, wherein the location of the backup cutter on the bit is further determined by:

calculating an actual $CDOC_b$ for the backup cutter using one of the following equations:

$$CDOC_b=((\delta-w)\times 360)/\theta \text{ or } CDOC_b=(w\times 360)/\theta; \text{ and}$$

comparing the actual $CDOC_b$ to the selected target $CDOC_b$ and if the actual $CDOC_b$ is not greater than or equal to the selected target $CDOC_b$, repeating the selecting the under-exposure, δ, step and subsequent steps with a different under-exposure, δ, or if the actual $CDOC_b$ is greater than or equal to the target $CDOC_b$, comparing the selected under-exposure, δ, to the selected wear, w, and, if the selected under-exposure, δ, is not greater than or equal to the selected wear, w, repeating the selecting a second blade step and subsequent steps with a different second blade, or if the selected under-exposure, δ, is greater than or equal to the selected wear, w, locating the backup cutter on the second blade at the angle, θ, with the under-exposure, δ; and a surface assembly to rotate the drill string and bit during use of the bit to drill a wellbore in a formation.

8. The system of claim 6, wherein the angle, θ, is 180 degrees or greater.

9. A method comprising:

providing an incomplete bit design including:

a bit body comprising at least two blades and having a bit rotational axis about with the bit rotates in a direction during use;

a primary cutter located on a first blade and having a profile angle, wherein the primary cutter is a major cutter at onset of use of the bit; and determining a location of a backup cutter track set with the primary cutter and having an under-exposure, δ, along the profile angle of the primary cutter, the backup cutter located on a second blade at an angle, θ, as measured from the primary cutter with respect to the bit rotational axis of the bit in a direction opposite the direction in which the bit rotates during use, wherein θ is greater than or equal to 150 degrees, wherein determining the location of the backup cutter comprises:

selecting a primary cutter on the first blade;

determining the profile angle of the primary cutter;

selecting a selected target critical depth of cut of the backup cutter ($CDOC_b$);

selecting the wear, w, of the primary cutter at which the backup cutter will engage a formation during use of the bit;

selecting a second blade for the backup cutter such that the angle, θ, based on this selection is greater than or equal to 150 degrees;

selecting the under-exposure, δ, of the backup cutter along the profile angle of the primary cutter;

calculating an actual $CDOC_b$ for the backup cutter using one of the following equations:

$$CDOC_b=((\delta-w)\times 360)/\theta \text{ or } CDOC_b=(w\times 360)/\theta; \text{ and}$$

comparing the actual $CDOC_b$ to the selected target $CDOC_b$ and if the actual $CDOC_b$ is not greater than or equal to the selected target $CDOC_b$, repeating the selecting the under-exposure, δ, step and subsequent steps with a different under-exposure, δ, or if the actual $CDOC_b$ is greater than or equal to the target $CDOC_b$, comparing the selected under-exposure, δ, to the selected wear, w, and, if the selected under-exposure, δ, is not greater than or equal to the selected wear, w, repeating the selecting a second blade step and subsequent steps with a different second blade, or if the selected under-exposure, δ, is greater than or equal to the selected wear, w, locating the backup cutter on the second blade at the angle, θ, with the under-exposure, δ.

10. The method of claim 9, wherein, the angle, θ, is between 150 and 210 degrees and the backup cutter becomes a major cutter during use of the bit and the primary cutter remains a major cutter while the backup cutter is also a major cutter.

11. The method of claim 9, wherein the angle, θ, is 180 degrees or greater.

12. The method of claim 9, wherein, the angle, θ, is between 210 and 330 degrees, the backup cutter becomes a major cutter during use of the bit, and the primary cutter becomes a minor cutter while the backup cutter is a major cutter.

13. The method of claim 9, further comprising manufacturing a drill bit according to the incomplete drill bit design with the backup cutter located on the second blade at the angle, θ, with the under-exposure, δ.

* * * * *